US007628342B2

(12) United States Patent
Shimoda et al.

(10) Patent No.: US 7,628,342 B2
(45) Date of Patent: Dec. 8, 2009

(54) LIQUEFIED GAS DISPENSING NOZZLE AND LIQUEFIED GAS DISPENSING APPARATUS

(75) Inventors: Yoshimichi Shimoda, Sagamihara (JP); Masami Matsunaga, Sagamihara (JP); Nobuyoshi Aoki, Shizuoka (JP); Nobushige Wakana, Sagamihara (JP); Hirokazu Murai, Chuo-ku (JP)

(73) Assignee: Daiwa Can Company, Tokyo (JP)

( * ) Notice: Subject to any disclaimer, the term of this patent is extended or adjusted under 35 U.S.C. 154(b) by 953 days.

(21) Appl. No.: 10/842,466

(22) Filed: May 11, 2004

(65) Prior Publication Data

US 2005/0252992 A1 Nov. 17, 2005

(51) Int. Cl.
*B05B 1/32* (2006.01)

(52) U.S. Cl. ..... 239/456; 239/541; 239/590

(58) Field of Classification Search ..... 239/452–454, 239/456–459, 460, 451, 541, 552, 553, 553.3, 239/553.5, 590, 590.3, 590.5, 502, 504, 506, 239/513, 518

See application file for complete search history.

(56) References Cited

U.S. PATENT DOCUMENTS

| | | | | |
|---|---|---|---|---|
| 3,520,481 | A * | 7/1970 | Moen | 239/428.5 |
| 4,120,431 | A * | 10/1978 | Schultz | 222/518 |
| 4,407,340 | A | 10/1983 | Jensen et al. | |
| 4,471,627 | A | 9/1984 | Hongo et al. | |
| 4,485,854 | A | 12/1984 | Roullet | |
| 4,703,609 | A | 11/1987 | Yoshida et al. | |

FOREIGN PATENT DOCUMENTS

| | | |
|---|---|---|
| JP | 52-115723 | 9/1977 |
| JP | 59-131097 | 7/1984 |
| JP | 62-33198 | 8/1987 |
| JP | 63-35933 | 9/1988 |
| JP | 63-44609 | 9/1988 |
| JP | 64-3734 | 1/1989 |
| JP | 1-10331 | 3/1989 |
| JP | 1-59170 | 12/1989 |
| JP | 2-57521 | 2/1990 |
| JP | 7-24567 | 1/1995 |
| JP | 9-58615 | 3/1997 |
| JP | 10-177092 | 6/1998 |
| JP | 10-250711 | 9/1998 |

* cited by examiner

*Primary Examiner*—Christopher S Kim
(74) *Attorney, Agent, or Firm*—Oblon, Spivak, McClelland, Maier & Neustadt, L.L.P.

(57) ABSTRACT

A liquefied gas dispensing nozzle having a cylinder with its axis in a vertical direction, and a plug to be inserted into the cylinder from above as its main elements. A plurality of slit portions for letting through the liquefied gas are formed in parallel in an axial direction of the cylinder from the upper end to the lower end in an inner circumferential face of the cylinder contacting to an outer circumferential face of the plug. A width of at least one or more pair of mutually opposed slit portions is generally constant from its upper end to lower end and its slit bottom is inclined so that the depth of the slit becomes gradually shallower from upper end to lower end. Each slit portion of the cylinder is closed with the plug when the plug, which is movable vertically relative to the cylinder, reaches the lowest end position. A rounded portion formed by rounding a corner portion of the lower end of the slit portion includes an inclined slit bottom.

7 Claims, 14 Drawing Sheets

LIQUEFIED GAS DISPENSING NOZZLE AND LIQUEFIED GAS DISPENSING APPARATUS

BACKGROUND OF THE INVENTION

1. Field of the Invention

The present invention relates to a liquefied gas dispensing nozzle for flowing or dropping liquefied gas to a container, and to a dispensing apparatus equipped with said nozzle for dispensing the liquefied gas to a container.

2. Discussion of the Background

Generally, in the customary way, tight sealing is executed by seaming a can lid on an opening portion of a can, subsequently to dispense a little amount of inert and extremely cold liquefied gas which vaporizes at room temperature (from 20° C. to 25° C.) and increases its volume substantially, such as liquid nitrogen or liquefied argon on the liquid level in the beverage-filled can, during a filling and packing in the can of a non-carbonated beverage, i.e., a coffee, a tea, a green tea, an isotonic drink, a lactic acid drink, a fruit juice, a beverage containing a fruit juice and so on, where the can has a thin plated trunk wall such as a drawn and ironed can. This is intended to prevent the can from a deformation due to external pressure by means of raising internal pressure of the sealed can, and to prevent the beverage from deterioration in the can by means of substituting the air in a head space (a space of an upper portion of the beverage) of the can with the inert gas so as to reduce the amount of remaining oxygen.

There are several types of liquefied gas dispensing apparatuses for such an application and those may be divided roughly in two types, such as a type of injecting the liquefied gas with dropping (i.e., flowing intermittently) into the can, and a type of dispensing the liquefied gas with flowing continuously. The former mentioned so-called dropping type injection apparatus is disclosed in the specification of U.S. Pat. No. 4,407,340, and the latter mentioned so-called flowing type dispensing apparatus is disclosed in the specifications of U.S. Pat. Nos. 4,703,609 and 4,471,627 for example.

Those dispensing apparatuses are constructed to drop or to flow the liquefied gas out of a nozzle. It is necessary for the flow rate of the liquefied gas flown out of the nozzle to be adjusted to the speed of canned product manufacturing line, however, the speed of canned product manufacturing line is varied continuously, or adjusted subtly in recent days. One example of a liquefied gas dispensing apparatus, which can vary the flow rate of the liquefied gas flowing out of the flowing nozzle of the liquefied gas dispensing apparatus per unit of time continuously and steplessly, complying with the stepless speed change of canned product manufacturing line, is disclosed in Japanese Patent Laid-Open No. 10-250711 (JP 10-250711).

The liquefied gas dispensing apparatus disclosed in JP 10-250711 has a nozzle which comprises a cylinder, and a plug to be inserted in sliding arrangement into the cylinder and to be moved in the axial direction as its main components. A number of slit portions are formed in parallel with the axial direction, on the inner circumferential face of the cylinder which contacts with the outer circumferential face of the plug. A depth of each slit portion decreases from an upper end to a lower end. Accordingly, an opening dimension of the nozzle becomes lager continuously as the plug is raised, and the flow rate of the liquefied gas may be increased continuously, and the flow rate of the liquefied gas may be decreased continuously as the plug is lowered on the other hand. Also, the liquefied gas flows through a plurality of slit portions and is divided into a plurality of string shaped flows, therefore, an impact shock due to a collision of the liquefied gas with the liquid surface of the beverage in the container is eased when the liquefied gas flows. Accordingly, the liquefied gas is prevented from spattering out of the container.

As a canned product filled with the aforementioned beverages, on the other hand, a demand for the use of a bottle-shaped can is increasing in recent days. The bottle-shaped can, as disclosed in the specifications of U.S. Pat. Nos. 5,718,352, 6,499,329, 6,463,776 and so on, is a metal can of which a diametrically small threaded neck portion, inclining shaped shoulder portion, and thin plated diametrically large cylindrical trunk portion are formed integrally. In case of dispensing the liquefied gas into the container of this kind through the aforementioned nozzle, the problem to be described hereafter could occur, because the opening diameter (20 mm to 30 mm) of the bottle-shaped cans is smaller in comparison with that (51 mm to 64 mm) of the ordinary drawn and ironed cans (DI cans) according to the prior art.

Namely, it is necessary for the width or the sectional dimensions of the flow path of the liquefied gas flowing out of the nozzle to be narrowed in accordance with the opening diameter of the bottle-shaped can, in order to dispense the liquefied gas flowing out of the nozzle into the bottle-shaped can as efficiently as possible. For that purpose, a diameter of the nozzle, and a diameter of the cylinder and the plug which construct a nozzle have to be made small. If so, as shown in FIG. 14 for example, the flowing condition of the liquefied gas Lg from the liquefied gas dispensing nozzle Nz is divided into string shape in the same number of the slit portions Gr of the cylinder Cy, directly underneath the nozzle Nz. However, a plurality of the string-shaped flows get gradually closer and interflow into a unified flow in the end, due to the inclination of the slit bottom of the slit portions Gr toward the center. Accordingly, the impact of the liquefied gas Lg becomes big when it is fallen onto liquid level in the can, and the liquefied gas Lg is spattered due to big rebound on the liquid level in the can. Thus, a wide variation in an internal pressure in each can after being sealed may result.

Moreover, according to the liquefied gas dispensing apparatus of the prior art, as disclosed in the specifications of U.S. Pat. Nos. 4,471,627, and 4,703,609 for example, a movable portion (a valve or etc. for opening and closing a nozzle hole) of the liquefied gas flowing nozzle is fixedly joined to the lower end of a rod which penetrates a liquefied gas reserving tank in longitudinal direction from above, the rod is moved vertically so that a movable portion of the nozzle is moved vertically thereby to open and close the nozzle.

In the liquefied gas flowing nozzle which is composed mainly of the cylinder and the plug as disclosed in the aforementioned Japanese Patent Laid-Open No. 10-250711, the flow rate of the liquefied gas is also changed with varying a raising position of the plug by means of controlling an upward moving range of the rod, together with opening and closing the nozzle by means of moving the rod vertically, with joining the plug as a movable portion of the nozzle fixedly to the lower end of a rod which passes though a liquefied gas passage being communicated with the liquefied gas reserving tank in a longitudinal direction from above.

Thus, in the liquefied gas dispensing apparatus which comprises a flowing nozzle or a dropping nozzle of the liquefied gas consisted of the cylinder and the plug, or a flowing nozzle or a dropping nozzle of the liquefied gas composed mainly of the cylinder and the plug, the installing position of the rod for moving the plug vertically and the installing position of the cylinder are aligned on a common axis, in order to allow the plug which is joined to the lower end of the rod to be inserted into the cylinder from above.

However, in case the axes of the rod and the cylinder are not accurately congruent with each other due to a slight misalignment of both installing positions, or due to a slight inclination of the rod, the plug is slightly inclined to the cylinder when the plug is inserted into the cylinder.

As a result, lopsided force is acted between the outer circumferential face of the plug (an outer circumferential face of a rod shaped plug portion) and an inner circumferential face of the cylinder (an inner circumferential face of a cylinder hole). In consequence, a phenomenon called galling is generated and this makes the plug inserted in the cylinder hard to move. When galling is generated, there is a possibility for the plug not to move vertically in a predetermined distance, even if the rod is driven with a predetermined driving force. Also, a problem such as deterioration in a sealing performance could occur, due to a degrading of closeness at a contact portion between the cylinder and the plug when the nozzle is closed.

Furthermore, the liquefied gas dispensing apparatus according to the prior art controls opening and closing of the valve of a liquefied gas feeding conduit communicating a primary tank of the liquefied gas and the reserving tank, based on the detection result of a height of the liquid level of the liquefied gas in the liquefied gas reserving tank which is detected by two fluid level sensors, as disclosed in the aforementioned specification of U.S. Pat. No. 4,471,627. Namely, the valve is opened as a result of detection of a first liquid level sensor that the liquid level falls to a predetermined level. And then, the valve is closed when a second liquid level sensor detects that the liquid level rises to a predetermined level. Thus, the height of the liquid level in the reserving tank is maintained generally constant by means of executing and suspending the feeding of the liquefied gas to the reserving tank from the primary tank.

However, the temperature of the liquefied gas fed from the primary tank is extremely low such as −196° C. in case of liquid nitrogen for example, so that the liquid nitrogen vaporizes partially as it passes through the feeding conduit and the liquid nitrogen being fed is pressurized when it enters the reserving tank. Consequently, the liquid nitrogen collides with the liquid level so hard and thereby the liquid level may be waved or vibrated significantly. If the liquid level waves or vibrates significantly, the liquid level sensor decides that the liquid level rises higher than the actual level and an erroneous detection of the liquid level arises. As a result, a complementary amount of the liquid nitrogen becomes smaller or inaccurate, therefore, the liquid level cannot be kept within the predetermined range in the reserving tank. Accordingly, it is possible to generate a big difference in the amount of the liquefied gas to be flown or dropped from the nozzle by means of its own weight.

SUMMARY OF THE INVENTION

An object of the present invention is to provide a liquefied gas dispensing nozzle to be attached to a liquefied gas dispensing apparatus with eliminating a problem of the prior art, such as a wide variation in the dispensing amount of the liquefied gas of each sealed container when the liquefied gas is dispensed to the aforementioned container having a diametrically small opening portion.

And, an object of the present invention is to provide a liquefied gas dispensing nozzle to be attached to a liquefied gas dispensing apparatus, which has a cylinder and a plug to be inserted into the cylinder, in which the plug is connected to the lower end of a rod moving vertically, and in which the plug is inserted into the cylinder without inclining even if axes of the rod for moving the plug vertically and the cylinder are not accurately congruent with each other.

Also, an object of the present invention is to provide a liquefied gas dispensing apparatus wherein its vertical and horizontal position is easy to be adjusted to a container moving along a conveying route and corresponding to changes in the kind of a container such as a can (changes in a shape of the container, a height dimension of the container, dimensions of an opening portion or etc.).

Moreover, an object of the present invention is to provide a liquefied gas dispensing apparatus in which a variation is small in a flow rate of the liquefied gas per predetermined time, or in a dropping rate of the liquefied gas per one operation of the valve.

Furthermore, an object of the present invention is to provide a liquefied gas dispensing apparatus having the aforementioned liquefied gas dispensing nozzle that successfully overcome the problems as discussed earlier.

According to the present invention, there is provided a liquefied gas dispensing nozzle; which has a cylinder with its axis in a vertical direction, and a plug to be inserted in sliding arrangement into the cylinder from above as its main elements; in which a plurality of slit portions for letting a liquefied gas therethrough are formed in parallel in an axial direction of the cylinder from an upper end to a lower end of an inner circumferential face of the cylinder; in which a width of at least one or more pairs of mutually opposed slit portions is generally constant from their upper end to lower end, and their bottoms are inclined so that the depth of the slits becomes gradually shallower from their upper end to lower end; and wherein each slit portion of the cylinder is closed with the plug when the plug is positioned the lowest relative to the cylinder; whereas corner portions of the lower end of the slit bottoms are rounded at the lower end of slit portions of the cylinder having inclined slit bottoms.

Accordingly, in the present invention, respective streams of the liquefied gas passing through the respective slit portions having the inclined slit bottom are guided along the inclined face of the bottom toward the center (i.e., the center of nozzle or the cylinder) and then biased along the rounded corner portion (R face) at the lower end portion of the respective slit portions, so that streams of the liquefied gas are directed vertically downwardly by own gravity. Namely, each stream is formed into string shape and flows in a downward direction. Accordingly, the respective string-like streams of the liquefied gas from the respective slit portions are stable and undisturbed, and may not mingle with one another on their way.

Also, according to the present invention, the flow rate of the liquefied gas (flow rate per unit of time) is varied continuously and steplessly by means of varying a rising position of the plug in accordance with the speed change of a manufacturing line of canned (or bottled) products such as beverages, when the liquefied gas is flown though each slit portion of the cylinder by rising the plug from the lowest end position.

Moreover, according to the present invention, a curvature radius of the rounded corner portion may be 0.1 to 0.5 mm. With this construction, the flow of the liquefied gas flowing along the bottom of the slit portion is changed effectively to downward (in vertical direction) along the curved face of the corner portion.

Furthermore, according to the present invention, a nozzle outlet portion, which is formed with each slit portion, and each lower end of the portion between the slit portions may be lower than its peripheral portion. With this construction, rounding of the lower end corner portion of each slit portion of the cylinder may be executed comparatively easily, and release of the liquefied gas from the lower end corner portion of each slit portion is improved. That is, flowing of the liquefied gas to the peripheral portion from the lower end of each slit portion is prevented or suppressed. If the aforementioned rounding is applied, flow of the liquefied gas flowing along the slit bottom of the slit portion may be changed effectively to downward (in vertical direction) along the curved face of the corner portion.

On the other hand, according to the present invention, there is provided a liquefied gas flowing nozzle; which has a cylinder with its axis in a vertical direction, and a plug to be inserted in sliding arrangement into the cylinder from above as its main elements; in which a plurality of slit portions for letting a liquefied gas therethrough are formed in parallel in an axial direction of the cylinder from an upper end to a lower end of an inner circumferential face of the cylinder; in which a width of at least one or more pairs of mutually opposed slit portions is generally constant from their upper end to lower end, and their slit bottoms are inclined so that the depth of slits becomes gradually shallower from their upper end to lower end; and in which each slit portion of the cylinder is closed with the plug when the plug is positioned the lowest relative to the cylinder; whereas the depth of the slit is generally constant from the lower end to the predetermined height (in other words, a distance from the lower end to the predetermined range of the slit portion in upward direction) of the slit portion in the vicinity of the lower end of the slit portion of the cylinder having an inclined slit bottom.

Namely, the slit bottom extends axially downwardly and radially inward part of the way and then vertically towards the bottom end of the cylinder.

With the nozzle thus constructed, the flowing liquefied gas heading in a somewhat central direction along the inclined face of the slit bottom then flows along the bottom slit portion having generally constant depth in the vicinity of the lower end of the slit portion and changes its flow downward (in vertical direction), so that each flow of string-shaped liquefied gas flowing down from the lower end of the slit portion always flows downward stably in the undisturbed string shape of the same number as the slit portion, without flowing into another flow of string shaped liquefied gas on the way.

Moreover, according to the present invention, the flow rate (flow rate per unit of time) of the liquefied gas passed through each slit portion having inclined slit bottom is varied continuously and steplessly, by varying a rising position of the plug in accordance with the speed of a manufacturing line of canned (or bottled) products such as beverages or the like.

Besides, a height of the portion from the lower end of the nozzle, wherein the depth of the slit is generally constant, may be 2 mm to 10 mm.

Furthermore, the liquefied gas dispensing nozzle according to the present invention, which has a fixing hole member having a hole portion penetrating vertically therethrough, and a plug having a rod-shaped plug portion which is inserted in sliding arrangement into the hole portion from above and which is longer than the vertical length of the hole portion, as its main elements; in which a plurality of slit portions for letting through the liquefied gas are formed on the outer circumferential face of the rod-shaped plug portion of the plug contacting with the inner circumferential face of the hole portion from its upper end to the lower end, in parallel with the axial direction of the plug; in which the slit bottom of at least 2 slit portions out of those plurality of the slit portions has a generally constant width from top to bottom, and is inclined to have its depth gradually deeper; and in which at least one or more pair of slit portions out of those plurality of mutually opposed slit portions have a generally constant depth with a predetermined height from the lower end of the slit portion (in other words, a distance from the lower end to the predetermined range of the slit portion in upward direction) in the vicinity of the lower end of the slit portion which has the inclined slit bottom is constructed to close the slit portion when the plug which is capable of moving vertically relative to the fixing hole member reaches the lowest end position.

Namely, the slit bottom extends axially downward and radially inward part of the way and then vertically towards the bottom end of the plug.

With the nozzle thus constructed, accordingly, the liquefied gas flows in a plurality of string-like streams through respective slit portions of the plug when the plug rises to a predetermined position from the lowest end position. Also, the streams of flow of the liquefied gas are intermittent as the plug rises to the predetermined position and subsequently moves down again to the lowest end position to close the slit portions. That is to say, it is possible to drop the liquefied gas. With such arrangement, impact of the liquefied gas falling on liquid surfaces in the container is minimized.

Also, the flow rate or the dropping rate (flow rate or dropping rate per unit of time) of the liquefied gas passed through each slit portion of the plug having inclined slit bottom is varied continuously and steplessly, by means of varying a rising position of the plug in accordance with the manufacturing speed of the manufacturing line of canned (or bottled) products such as beverages or the like.

Moreover, as at least one pair or more of opposed slit portions out of the plurality of the slit portions have a generally constant depth with a predetermined height from the lower end of the slit portion, in the vicinity of the lower end of the slit portions having the inclined slit bottom, so that each stream of the liquefied gas flowing down along the inclined slit bottom change the flowing direction downward (in vertical direction) along the bottom slit portion having generally constant depth in the vicinity of the slit bottom. Therefore, each stream of the liquefied gas falls without merging of each stream of the liquefied gas flowing from the lower end of the slit portions on the way when the liquefied gas flows continuously, and without flowing toward the center along the lower end face of the plug at the lower end of respective slit portions when the liquefied gas is dropped intermittently. In any event, the liquefied gas is dispersed when dropped onto the liquid level in the container.

With the nozzle according to the present invention, the plug is provided with a packing member above the portion where the slit portion of the rod-shaped plug portion is formed, and a bottom face of the packing member is formed into a congruent shape of an upper end face of the fixing hole member, so that when the plug is at the lowest end position, bringing the lower face of the packing member of the plug and the upper end face of the fixing hole member into contact with each other to close the nozzle.

Accordingly, a predetermined amount of the liquefied gas is dropped into each container passing underneath the dispensing nozzle, by means of e.g., raising the plug for a predetermined distance from the lowest end position, and then lowering the plug to the lower end position immediately (in an extremely short time), on the basis of a detection signal from a container detecting sensor or the like, which detects the container being filled with a content liquid right before the container passes underneath the dispensing nozzle.

Besides, according to the present invention, the upper face of the fixing hole member may be formed into an inclined face such as inclining downwards to the central hole portion from the outer circumferential portion. With this construction, the lower end of the rod-shaped plug portion of the plug is led to the hole portion through the inclined face of upper end of the fixing hole member when the plug is inserted into central hole portion of the fixing hole member. Therefore, the plug is inserted easily into the fixing hole member.

Moreover, according to the present invention, there is provided a liquefied gas dispensing nozzle which has a cylinder with an axis in a vertical direction, and a plug to be inserted in sliding arrangement into the cylinder from above as its main elements; wherein slit portions for letting through the liquefied gas are formed in any one of an inner circumferential face of the cylinder or an outer circumferential face of the plug contacting with each other; and which is constructed to close the nozzle when the plug which is movable vertically against the fixed cylinder reaches to the lower end position; whereas the plug and the rod for moving the plug vertically are connected movably through a universal joint.

According to the present invention, therefore, the plug is inserted into the cylinder without inclining in case that the plug is inserted into the cylinder from above, even if the axes of the rod and the cylinder are not accurately congruent with each other, since the rod and the plug are movable through the universal joint. Consequently, there is no possibility of galling between the outer circumferential face of the plug and the inner circumferential face of the cylinder, or a deterioration of sealability at the sealing contacts between the cylinder and the plug when the dispensing nozzle is closed.

According to the present invention, there is provided a packing member made of a material softer than that of the cylinder above the rod-shaped plug portion of the plug contacting with the inner circumferential face of the cylinder, and a lower face of the packing member is formed to be congruent with the shape of the upper end face of the cylinder.

With this construction, areas of sealing contacts between the upper end face of the cylinder and the packing member of the plug becomes large, so that sealability by means of such sealing of the upper end face of the cylinder and the packing member of the contacts when the dispensing nozzle is closed can be improved.

The packing member may be made from a synthetic resin. In such case, smoothness for moving the plug upward and downward is excellent and wear of the upper end face of the cylinder is prevented. Also, durability of the liquefied gas dispensing nozzle is improved by means of employing a resin which has an excellent cryogenic characteristic and an abrasion resistance, such as a fluorocarbon resin or a polyamide resin.

According to the present invention, there is provided a liquefied gas dispensing apparatus for dispensing the liquefied gas to the container passing underneath the dispensing nozzle, by reserving the liquefied gas fed from a supply source in the reserving tank temporarily, then flowing or dropping the liquefied gas through the dispensing nozzle communicated with the lower end portion in the reserving tank; wherein the reserving tank provided with the dispensing nozzle integrally on its lower portion is installed on a fixedly arranged supporting base member, movable in the vertical direction and in the horizontal direction perpendicular to the conveying route of the containers, through a vertically movable portion which is movable in the vertical direction and a horizontally movable portion which is movable in the horizontal direction.

In the liquefied gas dispensing apparatus according to the present invention, therefore, a width change and a height change of a guide provided on both sides of the conveying route of the containers in connection with a dimensional alteration of the container (diameter of the trunk portion or height of the container) to be used for manufacturing container filled with the beverage or the like is executed after removing the reserving tank from the conveying route, with moving the reserving tank upward by the vertically movable portion and horizontally by the horizontally movable portion. As a result, since the reserving tank does not interfere, changing of the guide position in both sides of the conveying route becomes easy.

Also, according to the present invention, positioning of the dispensing nozzle and the opening portion of the container (e.g., adjusting positions of the center of the opening portion of the container and the center of the dispensing nozzle, and adjusting the distance between the upper end of the opening portion of the container and the lower end of the dispensing nozzle as a predetermined distance) is executed easily by moving the reserving tank horizontally by the horizontally movable portion and vertically by the vertically movable portion.

Moreover, according to the present invention, visibility of the manufacturing line is improved in case of manufacturing container packed products in which the liquefied gas is not to be dispensed into the container, by means of moving the reserving tank including the dispensing nozzle to the side of the manufacturing line (conveying route of the container) from above, with moving the reserving tank in the horizontal direction subsequently to move the dispensing nozzle positioned in the lower end of the reserving tank above the guide of the conveying route of the container or the like by raising the reserving tank. Namely, an operator may easily observe trouble such as a falling or a jamming of the containers from a remote location or a monitor screen.

Besides, a mechanism for moving each movable portion may be a ball screw mechanism. With this construction, it is sufficient to turn a ball screw shaft for moving each movable portion. For example, if a handle is installed on one of the end portions of the ball screw shaft, an operator may move each movable portion by a required distance only by holding and turning the handle, without requiring any special power source. Also, if the ball screw shaft is connected with a power source such as a motor, the movable portion is moved by a predetermined distance by means of button operation.

And the liquefied gas dispensing apparatus according to the present invention may comprise a controller for detecting the weight of the reserving tank held by the movable portion, and for controlling the flow rate of the liquefied gas to supply the reserving tank from the supply source in compliance with the detected weight.

With this construction, a height of the liquid level is measured with accuracy from the change of the entire weight of the reserving tank, even though the liquid level surges deeply in the reserving tank right after supply of the liquefied gas from the supply source of the liquefied gas (primary tank). Namely, a weight of the reserving tank in an empty condition and a capacity of the reserving tank are measured in advance; therefore, measuring the entire weight of the reserving tank including the liquefied gas contained therein enables to calculate just a weight of the liquefied gas itself, and a volume corresponding to the calculated weight. Consequently, the height of the liquid level may be calculated from the volume and the previously measured capacity of the reserving tank.

Therefore, according to the method for controlling the height of the liquid level of the liquefied gas in the reserving tank by means of controlling the opening and closing of the valve mounted on the feeding conduit for the liquefied gas connecting the supply source and the reserving tank by using the aforementioned apparatus of the present invention for detecting the height of the liquid level, the height of the liquid level is accurately controlled in a narrower range as compared to a method for controlling the liquid level of the liquefied gas by using a set of liquid level detecting sensors according to the prior art.

Therefore, in the apparatus according to the present invention, the liquefied gas in the continuous flow or drop type dispensing nozzle is subjected to a constant pressure at all times that is created by gravity of the liquefied gas in the reserving tank, and as a result, variation in volume of the liquefied gas being released from the nozzle is kept to a minimum.

Based on this, variation in the amount of the liquefied gas dispensed into each container, in other words, variation in an internal pressure of each sealed container is minimized.

With a reserving tank of a liquefied gas dispensing apparatus according to the prior art, the liquid level detecting sensors, accommodated in a single or plurality of protective conduits, are suspended in the reserving tank via a through hole or holes that are formed in its upper wall. Consequently, an external heat (a heat from a temperature of ambient air which is approximately 200° C. higher than the temperature in the reserving tank) infiltrates into the reserving tank from the through hole of the upper wall and the protective conduit. As a result, vaporization of the liquefied gas is expedited and this causes a useless waste of the liquefied gas. However, the liquid level sensors are not employed in the apparatus according to the present invention so that, it is difficult for the external heat to infiltrate into the reserving tank and wasteful consumption of the liquefied gas is thereby prevented.

The above and further objects and novel features of the invention will more fully appear from the following detailed description when the same is read with reference to the accompanying drawings. It is to be expressly understood, however, that the drawings are for purpose of illustration only and are not intended as a definition of the limits of the invention.

DESCRIPTION OF THE PREFERRED EMBODIMENTS

Figure 1:
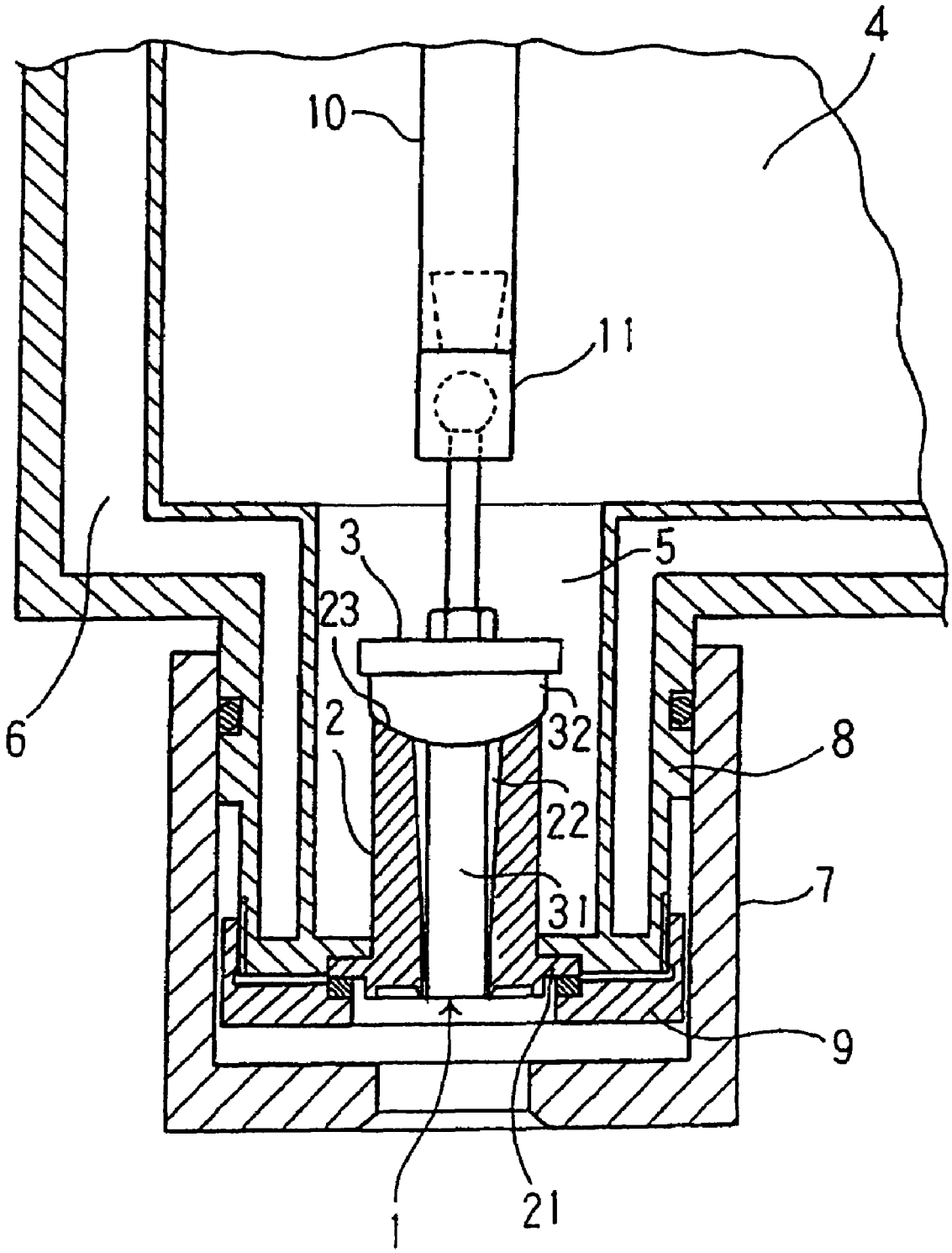
FIG. 1 is a longitudinal sectional view of an embodiment of the invention showing a lower end portion of a liquefied gas dispensing apparatus equipped with a liquefied gas dispensing nozzle.

In FIG. 1, a nozzle 1 of the liquefied gas dispensing nozzle according to an example of the present invention is depicted therein. This nozzle 1 is for feeding inert and extremely cold liquefied gas such as nitrogen gas or argon gas to a head space of a container such as a can or the like, which is filled with a content such as a beverage but unsealed. Nozzle 1 is mounted inside of a liquefied gas passage 5, which is provided in a bottom portion of a reserving tank 4 for reserving the liquefied gas temporarily.

Fundamental structures of the liquefied gas dispensing apparatus including the reserving tank 4 are disclosed in publications of Japanese Utility Model No. 63-35933, Japanese Utility Model No. 1-10331, Examined Japanese Pat. No. 1-59170 (corresponds to U.S. Pat. No. 4,471,627), and Japanese Patent Laid-Open No. 10-250711. The nozzle 1 according to an example of the present invention may be attached to the liquefied gas dispensing apparatus disclosed in those publications. FIG. 1, includes a partial view of the reserving tank 4. The reserving tank 4 is surrounded entirely by a vacuum heat insulating chamber 6. The liquefied gas passage 5 is formed so as to communicate with the bottom portion of the reserving tank 4. The nozzle 1 is arranged at the lower end portion of the liquefied gas passage 5.

The nozzle 1 shown therein comprises a cylinder 2 and a plug 3 for opening/closing the cylinder 2 and for adjusting the opening dimensions. Also, there is provided frost preventing cover 7 for preventing an adhesion of frost in the vicinity of an outlet of the nozzle 1, due to freezing of vapor in the atmosphere or rising from the beverage in the can, resulting from a refrigeration of the ambient air of the liquefied gas when the low-temperature liquefied gas is flown or dropped and passes therethrough. The frost preventing cover 7 is attached detachably to an outer cylindrical portion 8 which surrounds the liquefied gas passage 5 as a part of an outer wall of the vacuum heat insulating chamber 6. Moreover, it is constructed to bring the dried nitrogen gas into the space between the frost preventing cover 7 and the outer cylindrical portion 8, and to outflow the dried nitrogen gas from an opening portion at the lower end portion of the frost preventing cover 7. Besides, although not shown in the figure, a heater is mounted to the frost preventing cover 7 in order to prevent adhesion of frost in the vicinity of the opening portion by means of an outer face side of the frost preventing cover 7.

A flange portion 21 is formed integrally with an outer circumferential face of the cylinder 2 in the vicinity of its lower end portion. The cylinder 2 is fixed to a bottom wall of the liquefied gas passage 5 by means of cramping the flange portion 21 together with a packing by a cylinder cap 9 to be screwed to the outer circumferential face of the lower portion of the outer cylindrical portion 8. A long rod 10 leading in a vertical direction is arranged above the cylinder 2 with being allowed to move up and down, and the plug 3 is connected to a lower end portion of the rod 10 through a universal joint 11. The plug 3 is inserted in sliding arrangement into the cylinder 2 from above so that the plug 3 is moved up and down against the fixed cylinder 2 according to the vertical movement of the rod 10.

Figure 2:
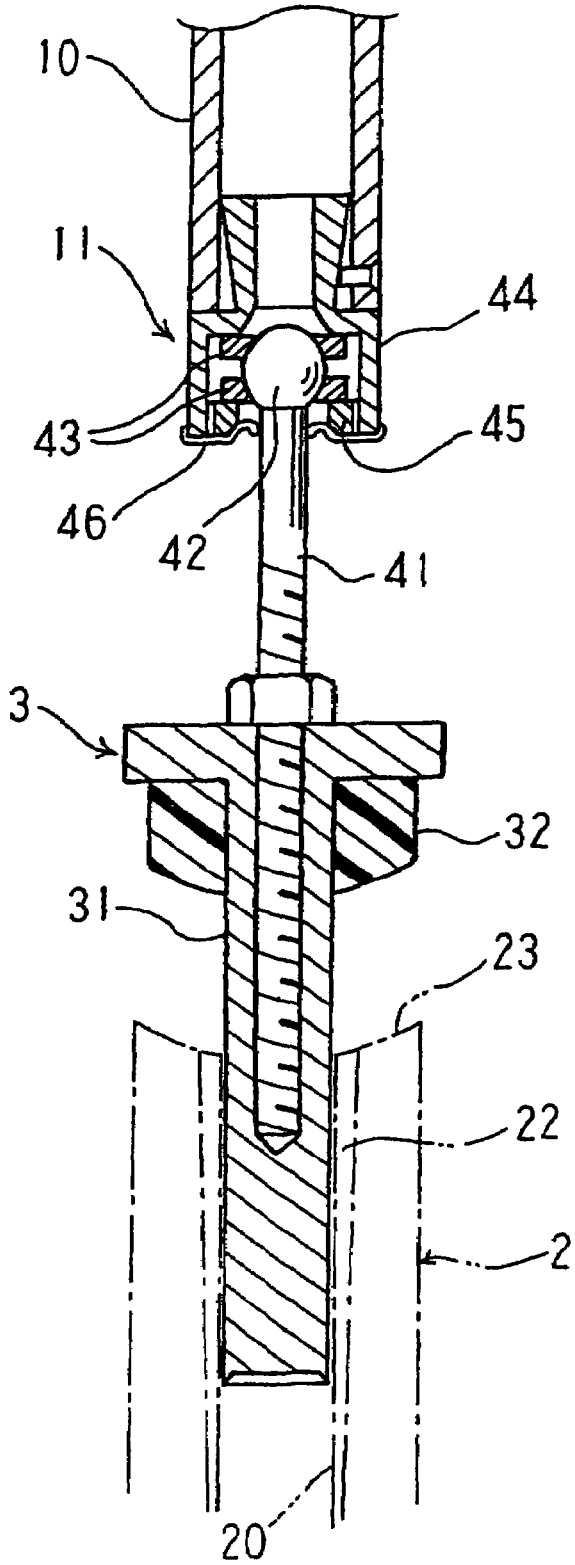
FIG. 2 is a longitudinal sectional view showing one example of a universal joint for connecting a plug and a rod.

One example of the universal joint 11 is depicted in FIG. 2. A ball portion 42 as a supporting point of oscillation is formed integrally with an upper end of a shaft member 41 which is to be screwed with the plug 3. The ball portion 42 is supported by a vertical pair of ring shaped top and bottom bearing members 43, and the ball portion 42 and the bearing members 43 are accommodated in a case member 44 which is fixed detachably to the lower end portion of the rod 10 under such condition. Moreover, the bearing member 43 is held inside of the case member 44 with being prevented from dropping out by a ring shaped stopper member 45, and the lower end portion of the case member 44 including the stopper member 45 is covered with a ductile cover member 46.

Accordingly, the plug 3 screwed to the shaft member 41 is capable of oscillating against the rod 10 equipped with the case member 44 in a fixed manner, taking the ball portion 42 as a supporting point. Also, the plug 3 is capable of sliding in an eccentric direction within a movable range in the case member 44 of the bearing member 43 which supports the ball member 42.

The plug 3, which is formed as protruding downward, comprises a column-like rod-shaped plug portion 31 which contacts with the cylindrical shaped inner circumferential face (a cylinder hole) of the cylinder 2, and a packing member 32 which is attached to the upper end portion of the rod-shaped plug portion 31. The packing member 32 is preferably comprised of a synthetic resin which has an excellent cryogenic characteristic, an abrasion resistance, and a smoothness, such as a fluorocarbon resin or a polyamide resin.

As shown in FIG. 1, an upper end face 23 of the cylinder 2 is formed into mortar shaped concave curved face (otherwise, it may be a mortar shaped tapered face). Also, a lower face of the packing member 32 is formed into convexity which is congruent with the concave upper end face 23 of the cylinder 2. Accordingly, the lower face of the packing member 32 contacts with the upper end face of the cylinder 2 almost entirely, if the rod shaped plug portion 31 is completely inserted into the cylinder 2 until the lower end of the rod-shaped plug portion 31 reaches to the lower end of the cylinder 2, i.e., under the condition that the plug 3 reaches to the lowest end position.

Figure 3A:
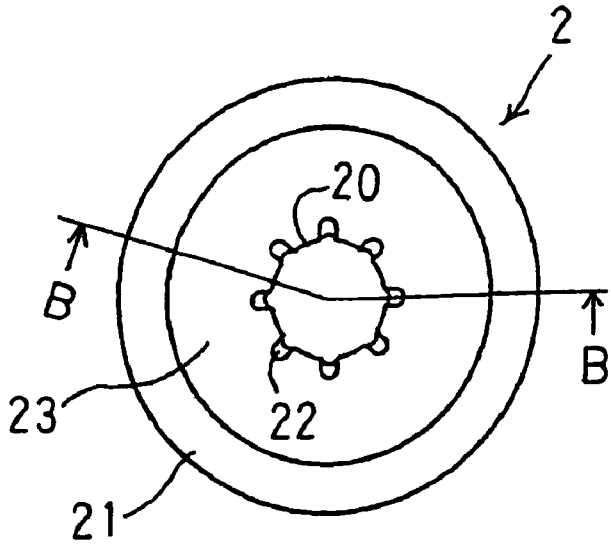
FIG. 3A is a top view showing a nozzle of FIG. 1.
Figure 3B:
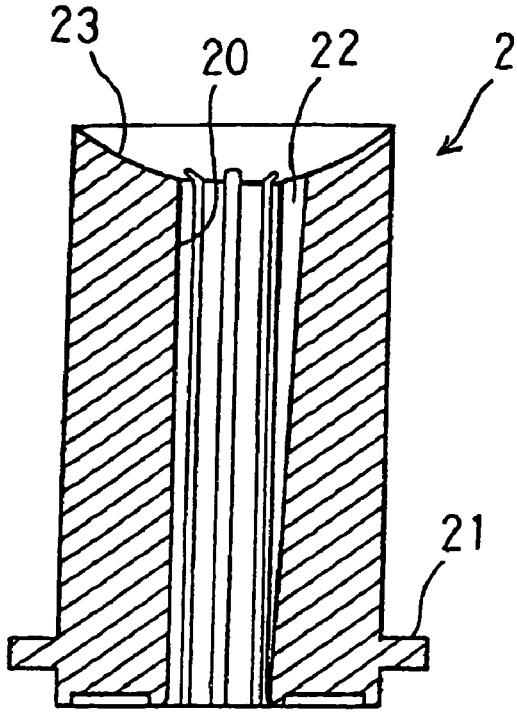
FIG. 3B is a longitudinal sectional view along B-B line in FIG. 3A.

As shown in FIGS. 3A and 3B, a plurality of slit portions 22 (8 slits for example as shown in the figures) are formed on the inner circumferential face 20 of the cylinder 2 with which the outer circumferential face of the rod-shaped plug portion 31 of the plug 3 contacts, in a radial pattern individually against the center axis of the cylinder 2, in a circumferential direction at even interval, and in parallel with the axial direction of the cylinder 2. Each slit portion 22 has a length from the upper end to the lower end of the inner circumferential face of the cylinder 2 and its width is generally constant, however, it has an inclined slit bottom. Namely, a depth of the slit bottom gets gradually shallower from the upper end portion to the lower end portion, and quite shallow in the vicinity of the lower end portion. In other words, each slit portion 22 almost disappears at the lower end portion of the inner circumferential face.

As shown in FIG. 1, according to the liquefied gas flowing nozzle 1 comprised of aforementioned cylinder 2 and plug 3, the lower face of the packing member 32 of the plug 3 contacts with the upper end face 23 of the cylinder 2, if the plug 3 is completely inserted into the cylinder 2 until the plug 3 reaches to the lowest end position. Therefore, all of upper end opening portions of each slit portion 22 of the cylinder 2 are sealed with the packing member 32 of the plug 3, and the nozzle 1 is closed completely. Accordingly, the liquefied gas reserved in the reserving tank 4 will not outflow from the liquefied gas passage 5 through the nozzle 1 under such condition.

Figure 4:
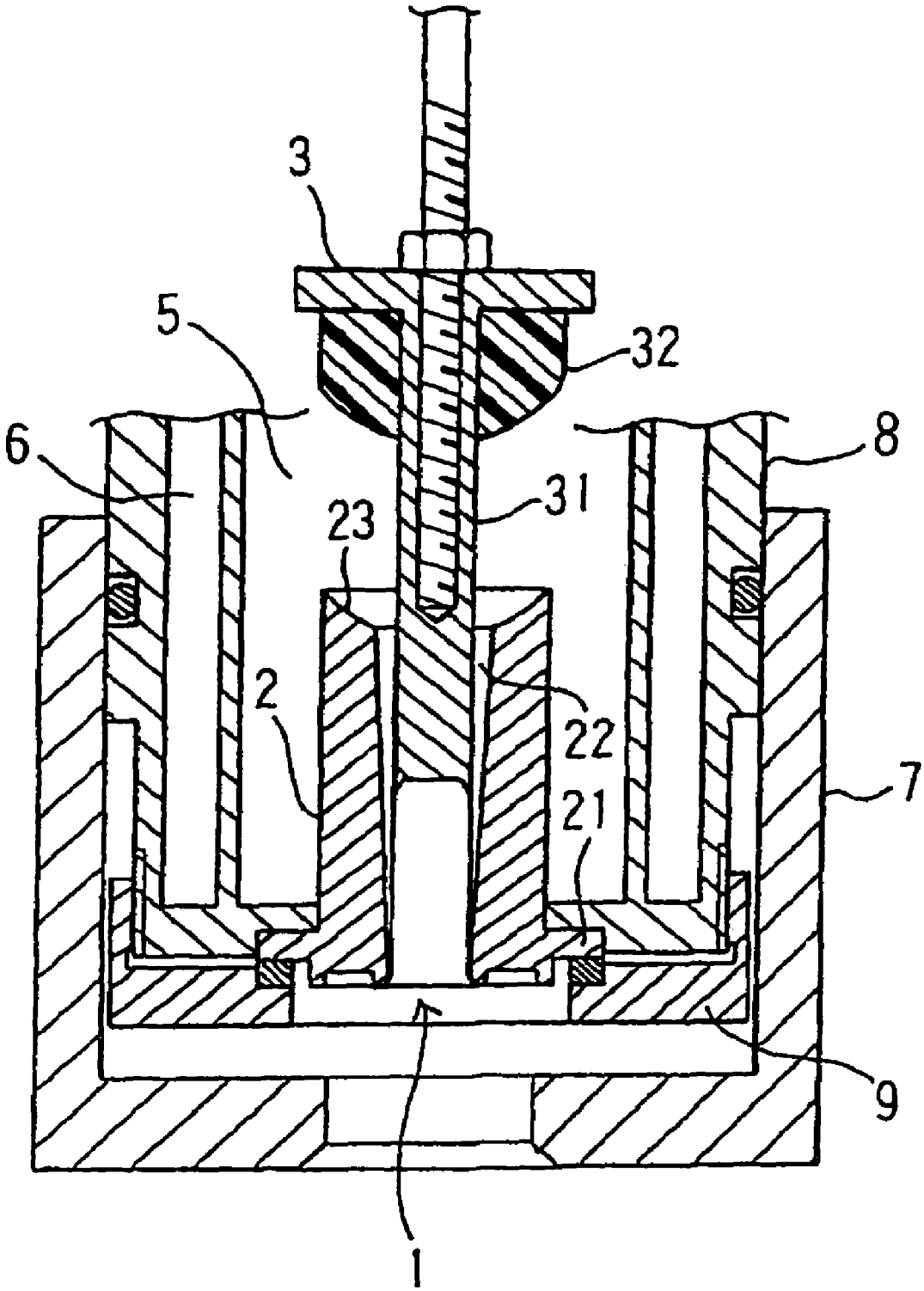
FIG. 4 is a longitudinal sectional view showing the liquefied gas dispensing nozzle of FIG. 1 being opened with desired opening.

As shown in FIG. 4, if the rod 10 is raised by a desired travel distance under such a condition, it moves the plug 3 upward by a desired level against the cylinder 2 and then stops. In this situation, the packing member 32 of the plug 3 departs upward from the upper end face 23 of the cylinder 2, and the upper end opening portion of each slit portion 22 of the cylinder 2 communicates with the liquefied gas passage 5. Also, each slit portion 22 is opened downward in order to let the liquefied gas pass in accordance with the depth of each slit portion 22 (side sectional area of the slit portion 22) of the cylinder 2 at the lower end position of the rod-shaped plug portion 31 of the plug 3 in a halting condition.

Therefore, the liquefied gas reserved in the reserving tank 4 flows down from the liquefied gas passage 5 through each slit portion 22 of the cylinder 2, in the flow rate in conformity to the side sectional area of each slit portion 22 of the cylinder 2 at the lower end portion of the plug 3. In such case, the liquefied gas flows along each slit portion 22 so that it flows downward with being divided into a plurality of narrow and homogeneous string shapes (8 strings, for example). Accordingly, the flow rate of the liquefied gas flowing through each slit portion 22 is varied steplessly and continuously by means of adjusting the rising position of the plug 3 against the cylinder 2 based on the travel distance of the rod 10 so as to change the side sectional area of each slit portion 22 (opening degree of the nozzle 1) opening downward.

One embodiment in which the control of the opening degree of the nozzle 1 by means of controlling the raising position of the plug 3 is applied to an actual canned product manufacturing line will be described in detail. First, examine following relations in advance, such as; relation between the position of the plug 3 and the flow rate of the liquefied gas per unit of time; and relation between the speed of the canned product manufacturing line and the necessary flow rate of the liquefied gas per unit of time for manufacturing the canned products in such speed (a flow rate by which a necessary internal pressure for the canned products to be manufactured can be obtained). Next, send a speed of the canned product manufacturing line to the computer with monitoring, thereby to calculate the position of the plug 3 corresponding to the speed. Subsequently, send a signal for indicating moving of the plug 3 to the calculated position to a servo motor (not shown) mounted on the upper of the rod 10, in order to move the plug 3 to the position where the necessary flow rate of the liquefied gas per unit of time for manufacturing the canned products in such speed of the manufacturing line can be obtained. Thus, the flow rate of the liquefied gas flowing out of the nozzle 1 is varied steplessly with corresponding to the stepless change of the line speed, by means of controlling the position of the plug 3 in such manner.

Figure 14:
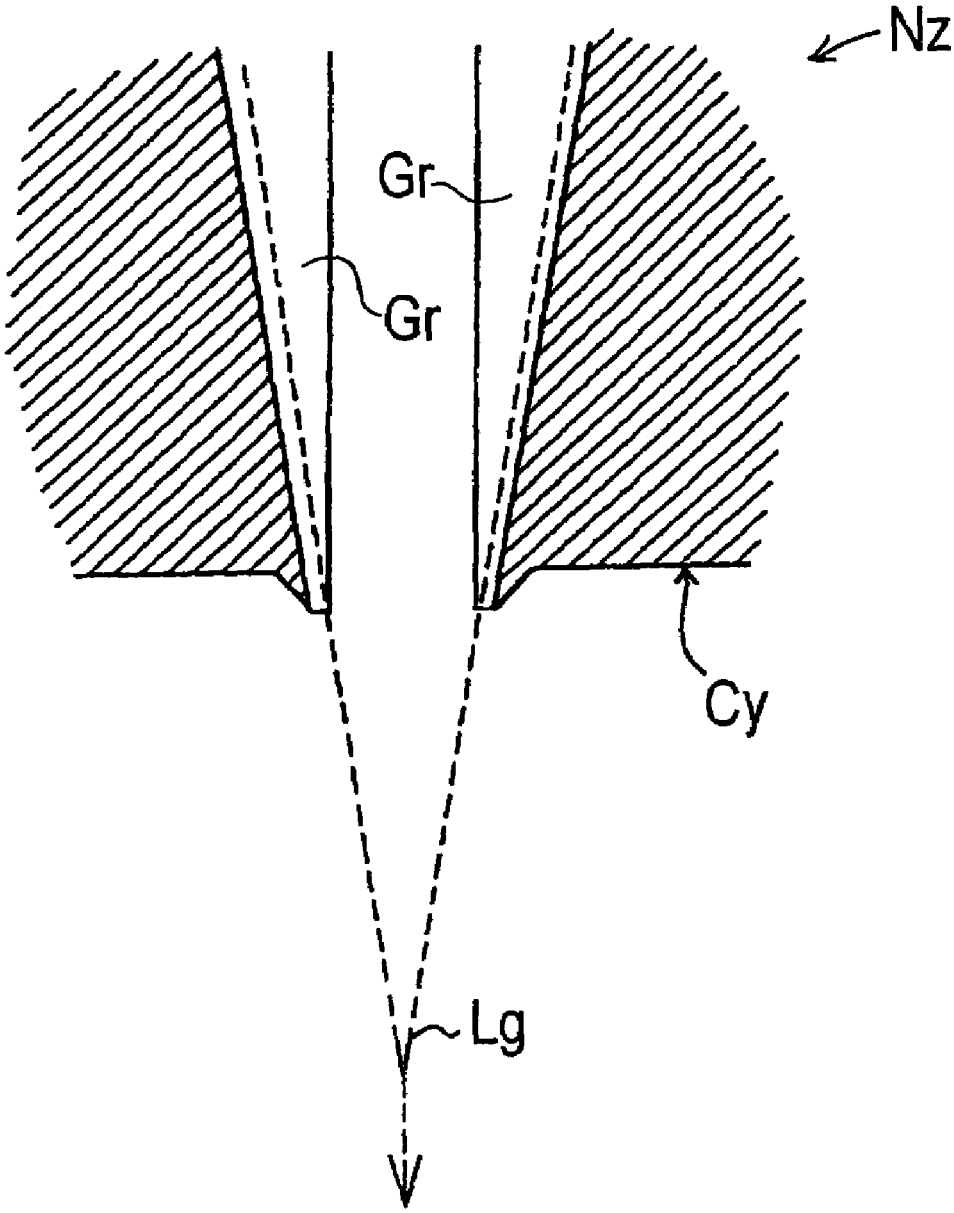
Fig.14 PRIOR ART
FIG. 14 is a longitudinal sectional explanatory drawing showing a flow of the liquefied gas through a slit portion of a cylinder in a liquefied gas dispensing nozzle which is mounted in a liquefied gas dispensing apparatus according to the background art.

Here, in case of the slit bottom of each slit portion formed on the cylinder of the liquefied gas dispensing nozzle is inclined to have the depth of the slit portion gradually shallower from the upper end to the lower end (inclined in the direction toward the center axis of the cylinder), the flowing condition of the liquefied gas is such that the liquefied gas flows down with being divided into narrow string-shaped flows of the same number (8 flows, for example) as the number of slit portions Gr underneath the nozzle Nz, as shown in FIG. 14. However, the narrow string-shaped flows from each slit portion Gr get gradually closer to each other on the way, and the flows are converged into unified large flow in the end (in other words, the eight narrow string-shaped flows flow into unified large flow). Consequently, there is a possibility of occurring of scattering for the liquefied gas depending on the distance between liquid level in the can and the nozzle Nz, due to big rebound at the liquid level arise from augmentation of the the impact when the liquefied gas Lg falls onto the liquid level in the can.

Figure 5A:
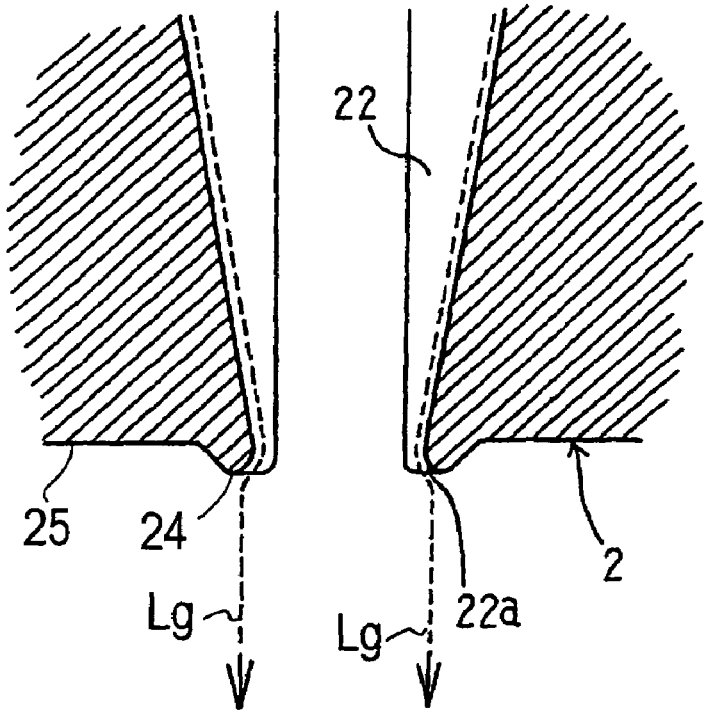
FIG. 5A is a longitudinal sectional explanatory drawing showing a flow of the liquefied gas through a slit portion of a cylinder in the liquefied gas flowing nozzle as shown in FIGS. 3A and 3B.
Figure 5B:
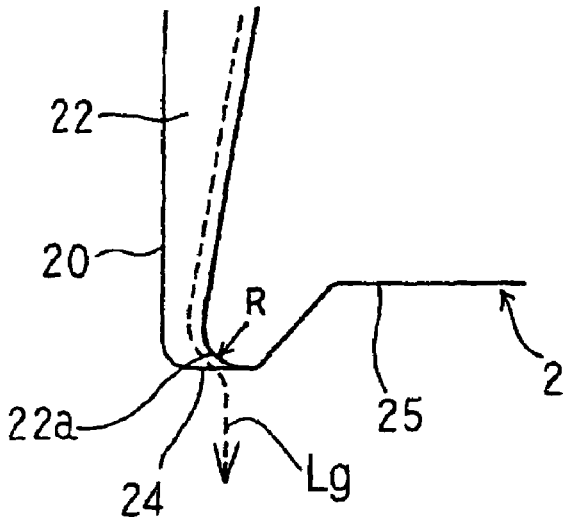
FIG. 5B is a closeup longitudinal sectional explanation drawing showing vicinity of lower end of the slit portion of the cylinder.

In order to cope with such a problem, in the liquefied gas dispensing nozzle 1 according to an embodiment of the present invention, a corner portion 22*a* at the lower end of the slit portion 22 is rounded as shown in FIG. 5A. Specifically, a peripheral portion of the lower end opening portion of the cylinder hole, i.e., a nozzle outlet portion 24 is protruded lower than a peripheral portion 25 of the outer circumferential side, as shown with being enlarged in FIG. 5B. A lower end face of the nozzle outlet portion 24 is formed into generally flat portion, and the corner portion 22*a* formed with the lower end face and the lower end of the slit bottom of the slit portion 22 is rounded to have a curvature radius R within 0.1 mm to 0.5 mm. Rounding is also applied to a lower end corner portion of the portion between each slit portion 22 (inner circumferential face 20 of the cylinder 2) in order not to have a burr.

According to the liquefied gas dispensing nozzle 1 of the embodiment of the present invention thus far described, an amount of the liquefied gas to be flown or dropped intermittently from the nozzle 1 through each slit portion 22 of the cylinder 2 is varied little by little continuously and steplessly in accordance with, e.g., stepless speed change of the canned product manufacturing line, only by changing the raising position (fixing position) of the plug 3 by controlling traveling distance of the rod 10. Therefore, a necessary amount of the liquefied gas to obtain the constant internal pressure is packed into the can, independently from the speed change of the manufacturing line.

Also, the liquefied gas flowing through a plurality of slit portions 22 of the cylinder 2 may flow into the can below, with being kept divided into even narrow string shapes, without interflowing on the way. Consequently, impact at the collision of the flowing liquefied gas against liquid surface of the beverage in the can is mitigated, so that the scattering of the liquefied gas out of the can due to the collision with the liquid level is prevented effectively.

That is to say, the flow of the liquefied gas Lg heading for somewhat central direction along the inclined face of the slit bottom of the slit portion 22 then flows along the curved face of the corner portion 22*a*, and changes its flowing direction downward with drawing outward little bit, due to the fact that the corner portion of the lower end of each slit potion 22 of the cylinder 2 is rounded as shown in FIG. 5. Each flow of the liquefied gas Lg subsequently flows in vertical direction by means of its own weight, therefore, the liquefied gas Lg flowing through each slit portion of the cylinder 2 flows into the can below with being kept divided into even narrow string shapes, without flowing into a unified large flow on the way. There is disclosed the fact in the specification of U.S. Pat. No. 4,703,609 that an amount of the liquefied gas to be packed to each container is equalized, in other words, the variation in the internal pressure in each container may be reduced, if the liquefied gas is discharged in the form of a narrow plurality of flows when it is dispensed to the container with being flown out of the nozzle, rather than the case that the liquefied gas is discharged out of the nozzle in the form of large unified flow. Therefore, further explanation is omitted herein.

Besides, in the aforementioned embodiment, because the curvature radius of the rounded corner portion 22*a* at the lower end of the slit bottom of the slit portion 22 is 0.1 mm to 0.5 mm, so that the flow of the liquefied gas Lg along the inclined face of the slit bottom of the slit portion 22 is changed effectively to downward (vertical) flow along the curved face of the corner portion 22*a*. Also, since the nozzle outlet portion 24 in the lower end portion of the cylinder 2 is protruded lower than its peripheral portion 25, the rounding is applied comparatively easily to the lower end corner portion 22*a* of each slit portion 22, and release from the lower end corner portion 22*a* of each slit portion 22 of the liquefied gas Lg is improved. Namely, it is possible for the flow of the liquefied gas to be prevented effectively from flowing with spreading to the peripheral portion from the lower end portion of each slit portion 22.

Moreover, since the rod 10 is connected with the plug 3 through the universal joint 11, no special obstruction arises even if the axes of the rod 10 and the cylinder 2 are not accurately congruent with each other, due to a slight misalignment of both installing positions of the rod 10 and the cylinder 2, or due to slight inclination of the rod 10. Namely, the plug 3 is not affected by the inclination of the rod 10 to the cylinder 2, and is inserted in sliding arrangement into the cylinder 2 without being inclined thereto. Consequently, a phenomenon of so-called galling does not occur between the outer circumferential face of the plug 3 (rod-shaped plug portion 31) and the inner circumferential face 20 of the cylinder 2 (cylinder hole) contacting each other, and the sealing performance at the contacting portion between the upper end face 23 of the cylinder 2 and the lower face of the packing member 32 of the plug 3 also is not deteriorated.

As shown in FIG. 3B, moreover, the upper end face 23 of the cylinder 2 is formed into mortar shaped concave curved face (or it may be a mortar shaped tapered face), so that the plug 3 is inserted easily into the cylinder 2 even if the physical relationship between the lower end portion of the plug 3 (lower end portion of the rod-shaped plug portion 31) and the cylinder hole of the cylinder 2 is misaligned due to inaccurate conformity of the axes of the rod 10 and the cylinder 2, when the plug 3 is inserted into the cylinder 2 from above.

A shape of the upper end face of the cylinder 2 may be formed into any shape including a flat face, as far as the lower face of the packing member 32 of the plug 3 has a congruent shape. However, if the upper end face of the cylinder 2 is formed into an inclined shape inclining downward from outer circumferential portion to the center portion such as an inclining mortar shaped tapered face or a concave curved face, the lower end portion of the plug 3 is compulsory led to the central cylinder hole due to the inclined face of the upper end of the cylinder 2 only by lowering the rod 10, even if the physical relationship between the lower end portion of the plug 3 (lower end of the rod-shaped plug portion 31) and the cylinder hole of the cylinder 2 is misaligned, when the plug 3 is inserted in sliding arrangement into the cylinder 2 from above. Accordingly, the plug 3 is inserted into the cylinder 2 easily.

Besides, if the upper end face 23 of the cylinder 2 is formed into the mortar shaped concave curved face and the lower face of the packing member 32 of the plug 3 is formed into the convex curved face to be congruent with the concave curved face, as shown in FIG. 3B, the contacting dimensions between the upper end face 23 of the cylinder 2 and the lower face of the packing member 32 of the plug 3 is enlarged in comparison with the mere tapered face. As a result, the sealing performance by means of contacting of the upper end face 23 of the cylinder 2 and the packing member 32 of the plug 3 is improved when the nozzle is closed.

Next, another embodiment of the liquefied gas dispensing nozzle according to the present invention will be described hereafter. In the aforementioned embodiment, the rounding is applied to the corner portion at the lower end opening side of the slit portion 22 in order to prevent the liquefied gas flowing along the slit portion 22 from interflowing. However, the so-called straight portion of the slit portion may be formed alternatively. According to a closeup sectional view of the lower end portion of an example of the nozzle 1 shown in FIG. 6, the depth of the slit portion 22 is generally constant over the predetermined height H from the lower end portion of the slit portion 22 (or over the range of the predetermined height H from the lower end portion). Namely, the slit bottom is led generally in vertical direction over the predetermined height H from the lower end portion of the slit portion 22 without inclining, and this portion is so-called straight slit. Additionally, the height H of the straight slit is preferably 2 mm to 10 mm, above all, 3 mm to 8 mm is especially preferable. Besides, in FIG. 6, a construction identical to that of the aforementioned embodiment will be omitted on its description by designating it by common reference numerals.

Figure 6:
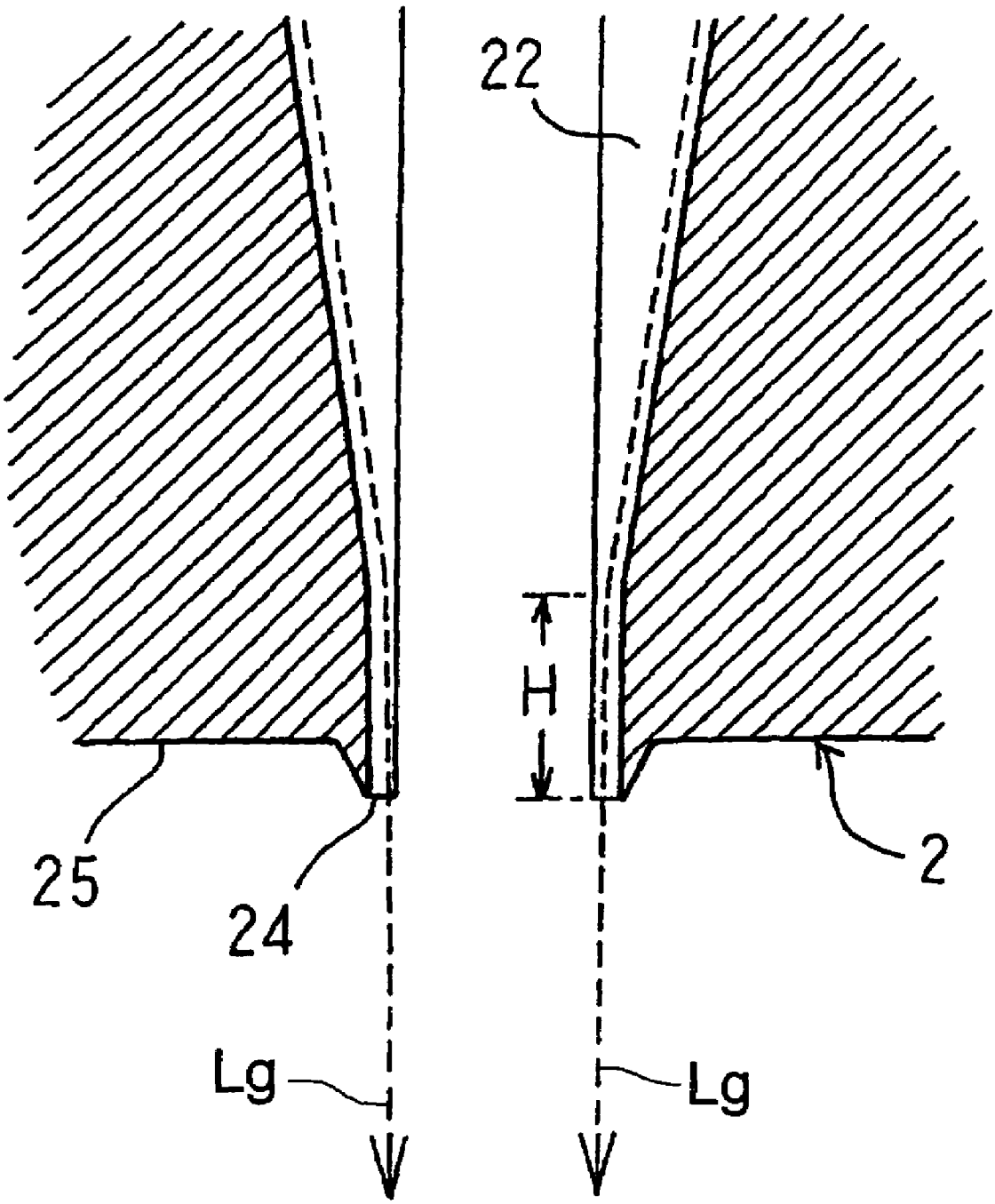
FIG. 6 is a closeup longitudinal sectional view showing an end portion of a cylinder in a liquefied gas flowing nozzle according to another example of the present invention.

Accordingly, with the construction of the nozzle 1 as shown in the example of FIG. 6, the depth of the slit potion 22 is generally constant over the predetermined height H from its lower end, so that the flowing liquefied gas Lg heading in somewhat central direction along the inclined face of the slit bottom of the slit portion 22 changes its flow downward (vertical direction) in the vicinity of lower end of the slit portion 22 (within the range of the predetermined height H from the lower end). Therefore, each stream of the liquefied gas Lg through each slit portion 22 may not be mingled with one another into a large stream but remain a stable string-like stream when received in a can.

Here, as mentioned above, the rounding of the corner portion of the lower end of the slit bottom at the lower end of the slit portion is also effective for the liquefied gas to be flown with being divided into even string shape, and it is especially preferable for the corner portion to be rounded if the aforementioned predetermined height H is short (1 mm to 3 mm).

Figure 7:
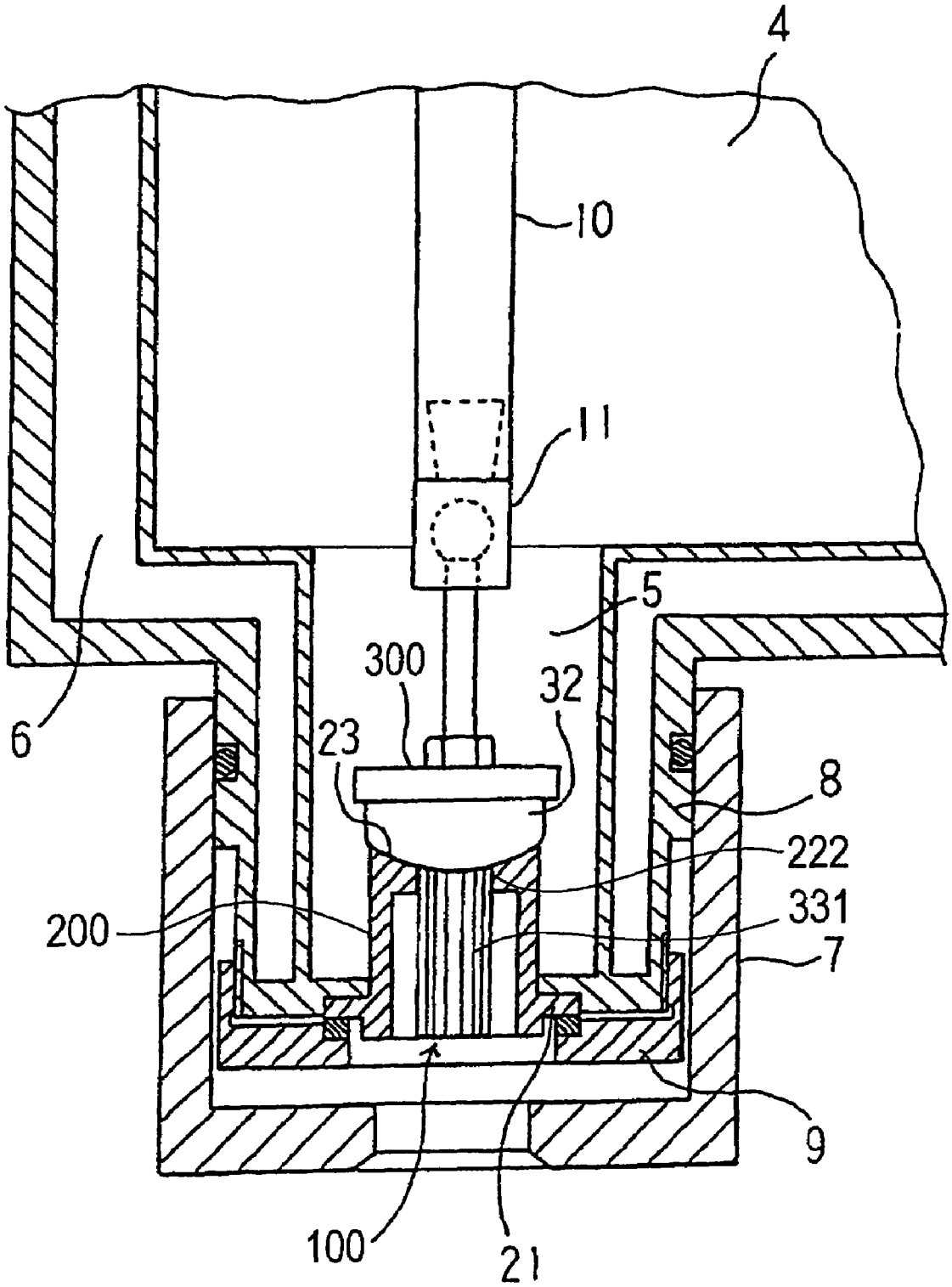
FIG. 7 is a longitudinal sectional view showing a lower end portion of a liquefied gas dispensing apparatus being equipped with still another liquefied gas dispensing nozzle according to an example of the present invention.
Figure 8:
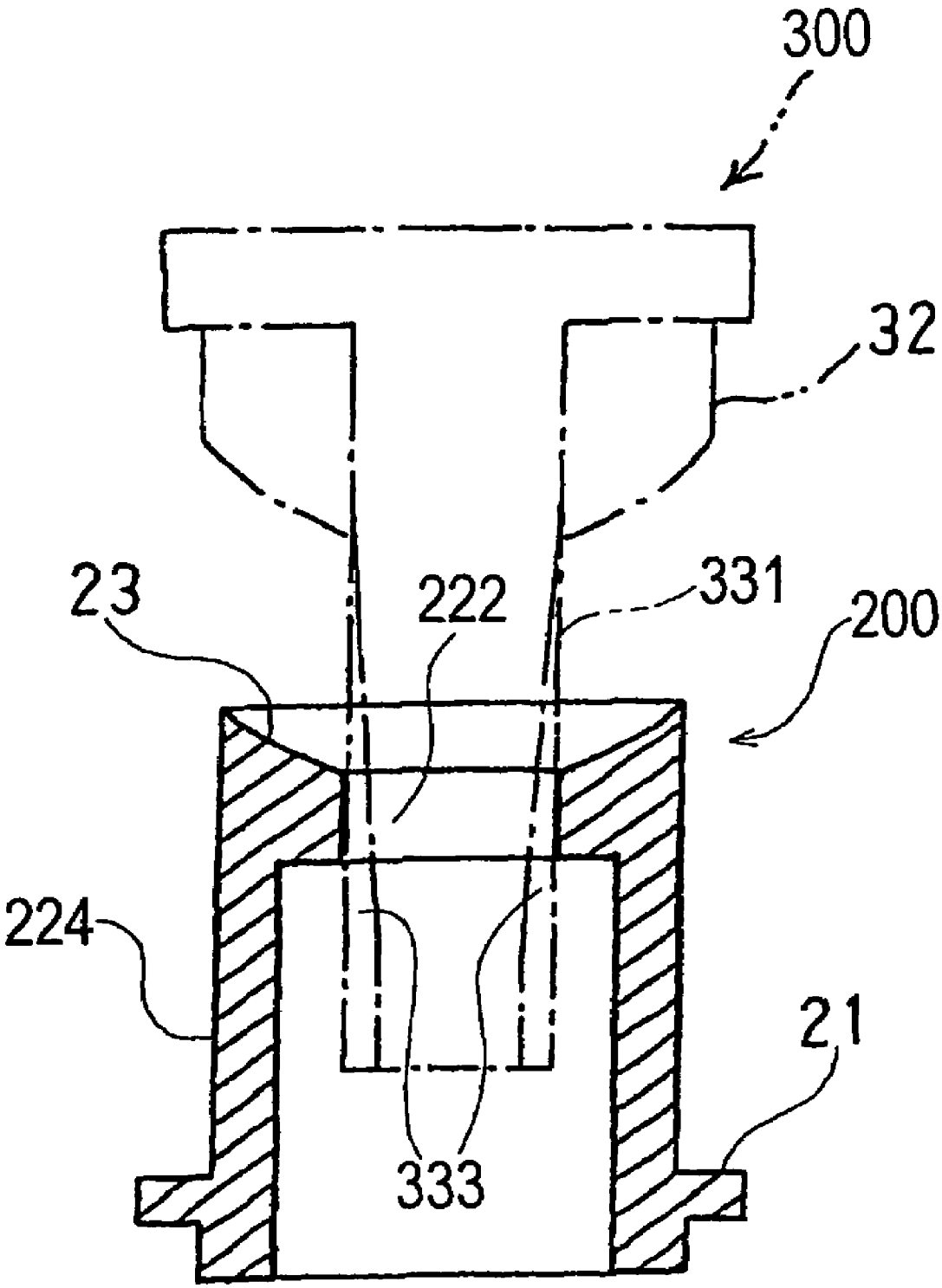
FIG. 8 is a longitudinal sectional view showing a structure of a fixing hole member in the liquefied gas dispensing nozzle shown in FIG. 7.

Still another embodiment of the liquefied gas dispensing nozzle according to the present invention will be described hereafter. The embodiment to be described below is an example of the slit portion for flowing or dropping the liquefied gas which is formed in an outer circumferential face of the rod-shaped plug portion of the plug instead of the inner circumferential face of the cylinder. In FIGS. 7 to 9, other constructions identical to that of the aforementioned embodiments shown in FIGS. 1 to 5 will be omitted on its description by designating them by common reference numerals.

A nozzle 100 shown in FIG. 7 has a cylindrical shaped fixing hole member 200. This fixing hole member 200 is fixed to an outer cylindrical portion 8, by means of clamping a flange portion 21 formed on its outer circumferential portion of the lower end, with a cap 9 screwed to the lower end portion of the outer cylindrical portion 8, and with a packing being interposed therebetween. The fixing hole member 200 is shaped into cylindrical shape having a bottom opening to the lower end side, as shown in the closeup view of FIG. 8, and a short cylindrical hole portion 222 is formed on the central portion of the bottom portion in the vicinity of an upper end of a cylindrical portion 224, penetrating therethrough in vertical direction. A rod-shaped plug portion 331 of a plug 300 is formed into column shape having a longer length than the vertical length of the hole portion 222, and is inserted in sliding arrangement into the hole portion 222 of the fixing hole member 200 from above. And, the outer circumferential face of the rod-shaped plug portion 331 of a plug 300 is to be contacted with an inner circumferential face of the hole portion 222 of the fixing hole member 200. Additionally, a vertical length of the hole portion 222 of the fixing hole member 200 may be an appropriate length, however, manufacturing becomes easy and a material may be saved if it is shortened as shown in FIG. 8 (3 mm to 6 mm).

Figure 9A:
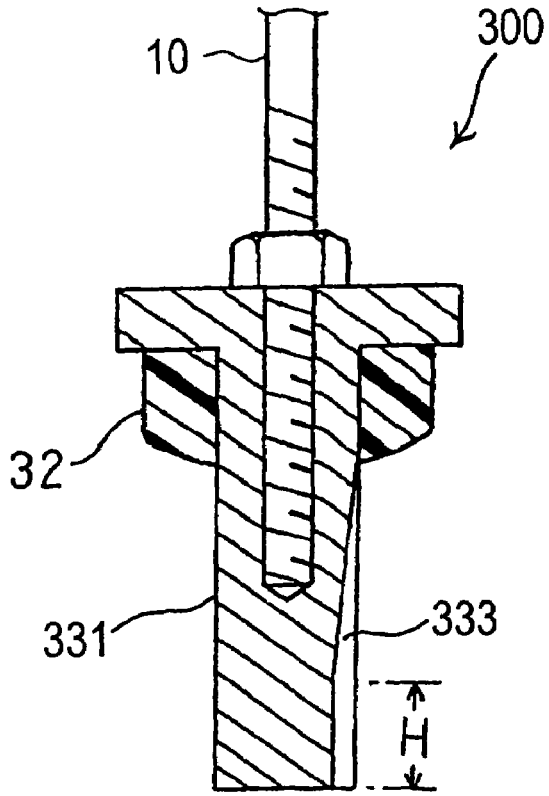
FIG. 9A is a longitudinal sectional view showing a plug of the nozzle shown in FIG. 7 along the A-A line in FIG. 9B.
Figure 9B:
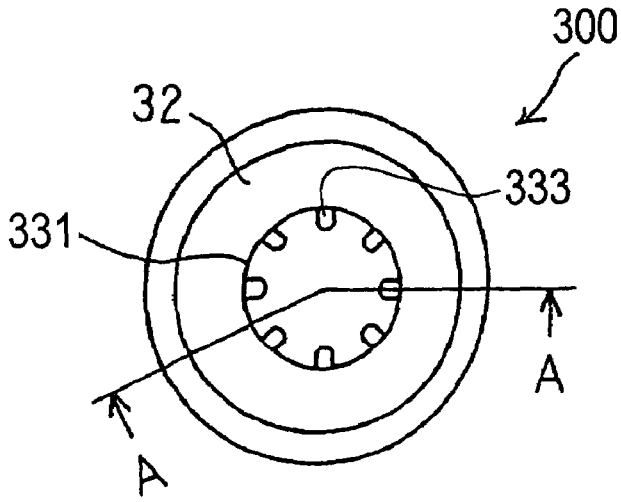
FIG. 9B is a bottom view showing the plug of the nozzle shown in FIG. 7.

In the plug 300, there is formed a plurality of slit portions 333 between the upper end to the lower end of the outer circumferential face of the rod-shaped plug portion 331 which contacts with an inner circumferential face of the hole portion 222 of the fixing hole member 200, as shown in FIGS. 9A and 9B. Those slit portions 333, each having generally constant width, become deeper gradually towards their lower end portions, then flat in the vicinity of the lower end. Namely, each slit has inclined bottom surfaces that extend gradually, diametrically, inwardly towards its lower end, then such surfaces is parallelized with an axis of the plug 300. And those slit portions 333 are in a radial pattern against the center axis of the plug 300, and are formed plurally (8 slits in the example of the figure) in a circumferential direction at even intervals, in parallel with the axial direction of the plug 3 individually.

The change of the depth of the slit portion 333 or the inclination of its slit bottom will be further described. It is sufficient if at least one slit portion 333 the slit bottom of which is inclined so as to vary its slit depth gradually as mentioned above. Moreover, the inclination of the slit bottom is varied at the lower end portion of the plug 300. An example of such is shown in FIGS. 8 and 9A. In the example shown in those figures, the depths of all the slit portion 333 are generally constant over the range of the predetermined height H from the lower end portion of the plug 300 (or in the portion between the lower end portion of the plug 300 and the upper portion by the predetermined distance H from the lower end portion). Namely, the slit bottom is in parallel with the axial direction and not inclined over the range of the predetermined height H from the lower end portion of the plug 300. Besides, the predetermined height H is preferably 2 to 10 mm. Moreover, those slit portions 333 are formed on the outer circumferential side of the plug 300, therefore, those are easy to be processed even when a plural number of those are to be formed thereon.

Dispensing of the liquefied gas in containers such as metal cans by means of a nozzle 1 or 100 according to the present invention can be effected by releasing the liquefied gas from the nozzle continuously and downwardly and moving the containers one after another consecutively thereunder, or by moving the containers one after another consecutively under the nozzle and releasing the liquefied gas from the nozzle intermittently and downwardly (or releasing droplets of liquefied gas) by means of reciprocal movements of the rod 10 that is driven for a given amount of upward stroke after a lapse of extremely short period of time by a drive mechanism that is actuated by signals being outputted from a sensor whenever each container reaches a region in the vicinity of the nozzle. A control in case of flowing the liquefied gas continuously with using the aforementioned nozzle 100 shown in FIGS. 7 and 9B may be executed identically to that of the control of the aforementioned nozzle 1 in the first embodiment.

On the other hand, a control in case of dispensing the liquefied gas to the container such as a can in a dropping manner may be executed as will be described hereinafter. First, examine the following relations in advance such as; relation among a raising position of the plug 300 and a remaining time of the plug 300 to stay in such position, and a dispensing (falling or dropping) rate of the liquefied gas; relation between a speed of the canned product manufacturing line and a passing time of the opening portion of the can underneath the nozzle 100 (possible time for the can to receive the liquefied gas to be flown out of the nozzle 100) when manufacturing canned products in such line speed; and relation between the speed of the canned product manufacturing line and the falling (dropping) rate of the liquefied gas by which a necessary internal pressure of the canned products to be manufactured can be obtained; then input those into the computer. Next, send a speed of the canned product manufacturing line to the computer with monitoring, thereby to calculate the position of the plug 300 corresponding to such speed and the staying time in such position, and send a signal for indicating moving of the plug 300 and the staying time of such position to a servo motor (not shown). Thus, the necessary dispensing amount of the liquefied gas for manufacturing the canned products in such a speed can be obtained by means of controlling the vertical movement of the plug 300 in such manner. Moreover, since the depth of the slit portion 333 varies continuously, and the raising position of the plug 300 and its staying time at the raising position may be controlled arbitrarily, the amount of the liquefied gas to be dropped (or flown intermittently) from the nozzle 100 may be varied steplessly in accordance with the stepless change of the line speed. Here, the staying time of the plug 300 at the predetermined raising position could be almost zero, depending on the speed of the canned product manufacturing line.

When the liquefied gas is dispensed to the container which has a considerably small opening portion for an outer diameter of its trunk portion, it is preferable for the opening portion of the container to be passed through the liquefied gas flowing out of the nozzle 100. Namely, the nozzle 100 is opened before the front end portion of the opening portion of the container passes underneath the liquefied gas falling (dropping or flowing intermittently) from the nozzle 100. Accordingly, the liquefied gas falling at the beginning is fallen out of the opening portion (i.e., forward of the front end portion of the opening portion). The rear end portion of the opening portion of the container passes through the liquefied gas falling from the nozzle 100 under such a condition, and the liquefied gas is dropped into the container in the meantime. Then, the nozzle 100 is closed. Thus, the variation in the amount of the liquefied gas to be dispensed to each container may be minimized by this means even if the opening diameter of the opening portion is small.

According to the aforementioned liquefied gas dispensing nozzle 100, the liquefied gas may be flown through a plurality of slit portions 333 formed on the plug 300 by means of raising the plug 300 from the lowest end position to a predetermined elevation position and holding it therein. Also, droplets of the liquefied gas can be released through a plurality of slit portions 333 formed in the plug 300 by moving the plug 300 reciprocally between its lowest position and the predetermined elevation position. In any of those dispensing patterns, flow of the liquefied gas is formed into streams of continuous strings or droplets by the slit portion 333. As a result, the impact arises from the collision of the liquefied gas with the liquid level in the container is reduced, so that the liquefied gas is prevented from scattering out of the container due to the collision with the liquid level.

Additionally, the flow rate or the dropping rate of the liquefied gas (the flow rate per unit of time or dropping rate within the predetermined time) through the slit portion 333 whose depth is varying gradually may be varied continuously and steplessly, by means of changing the raising position of the plug 300 with controlling the traveling distance of the rod 10. Accordingly, in case of the canned product manufacturing line for example, necessary amount of the liquefied gas to obtain the constant internal pressure of the can when sealed, independent of the speed change of the manufacturing line is dispensed into the can by means of varying the flow rate (the dropping rate) of the liquefied gas from the nozzle 100 continuously little by little and steplessly, in accordance with the stepless variation in the conveying speed of the can.

In recent years, application of metal cans of which a threaded neck portion and a thin plated trunk portion are formed integrally (i.e., bottle shaped can) has been wider for various type of beverages. An opening diameter of an opening portion of the bottle shaped can of this kind is e.g., approximately 20 mm to 30 mm, and is rather smaller diameter than the opening diameter of DI cans (normally approx. 48 to 60 mm) which are widely used so far. Accordingly, unlike liquefied gas dispensing nozzles that are intended for use with containers having a relatively large opening such as drawn and ironed beverage cans, a nozzle for dispensing liquefied gas into containers having relatively small spout needs to be made in its diameter.

The diameter of the rod-shaped plug potion of the plug has to be small (thin) in order to make the diameter of the liquefied gas dispensing nozzle small. In such case, opening ends of each slit portion at the lower end portion of the rod-shaped plug portion are made closer to each other. If the depth of at least a pair of slit portions opposing to each other about an axis of the rod-shaped plug portion changes continuously to the lower end of the plug, the respective streams of liquefied gas flowing through such slit portions, when released, will essentially cross with each other in the vicinity of the lower end of the rod-shaped plug (or a tip of the nozzle). Consequently, a plurality of streams of the liquefied gas divided by each slit portion interflows into a unified stream (in other words, becomes unified stream with merging) before reaching the opening portion of the can, otherwise, a plurality of small drops of the liquefied gas interflows into one drop in case of the liquefied gas is dropped intermittently. No matter if liquefied gas is released from the nozzle continuously or intermittently, substantial impact is created when the liquefied gas falls onto surfaces of a liquid product in a can to such extent that the gas may be splash against the liquid surface and scatter around, causing significant variations of internal pressure between a can and another when sealed.

On the other hand, in the example of nozzle 100 shown in FIGS. 7 to 9B, the depth of at least one pair of slit portions 333 positioned being opposed to each other in the diametrical direction of the rod-shaped plug portion 331 of the plug 300 is constant within a range of the predetermined height H from the lower end of the rod shaped plug portion 331. Namely, at the lower end portions of the slit portions 333, liquefied gas flows through the slit portions generally in parallel with an axis of the rod-shaped plug 331, so that such respective streams may not cross with one another in the vicinity of the tip of the nozzle 100.

Accordingly, even if the rod shaped plug portion 331 of the plug 300 is made relatively small in diameter, a plurality of streams of the liquefied gas from the lower end of respective slit portions 333 may not be mingled with one another on their way, when the liquefied gas is flown continuously. Also, when the liquefied gas is released intermittently or continuously, a plurality of streams of the liquefied gas out of the respective slit portions 333 fall straight down without being biased to center along the lower end face of the plug 300 (rod-shaped plug portion 331). In any case, the liquefied gas is fallen onto the liquid level in the container in a divided manner.

Besides, the outer face of the cylindrical portion 224 of the fixing hole member 200 is contacted with low-temperature liquefied gas and cooled when the liquefied gas is flown or dropped from the nozzle 100, so that the ambient atmosphere of the liquefied gas flowing along each slit portion 333 of the plug 300 is maintained in a low temperature. Accordingly, the liquefied gas is prevented from vaporizing, and fluctuation of the flow rate or dropping rate of the liquefied gas is thereby prevented or suppressed.

Here, because the upper end face 23 of the aforementioned fixing hole member 200 is tapered or formed into the mortar-shaped concave curved face, insertion of the rod-shaped plug portion 331 of the plug 300 into the hole portion 222 becomes easy. Also, because the convex curved face corresponding to the concave curved face is formed on the lower face of the packing member 32, the hole portion 222 is completely sealed in consequence of the entire upper end face 23 of the fixing hole member 200 being in contact with the lower face of the packing member 32, by means of lowering the plug 300 to the lower end position. That is to say, the nozzle 100 is closed.

Figure 10:
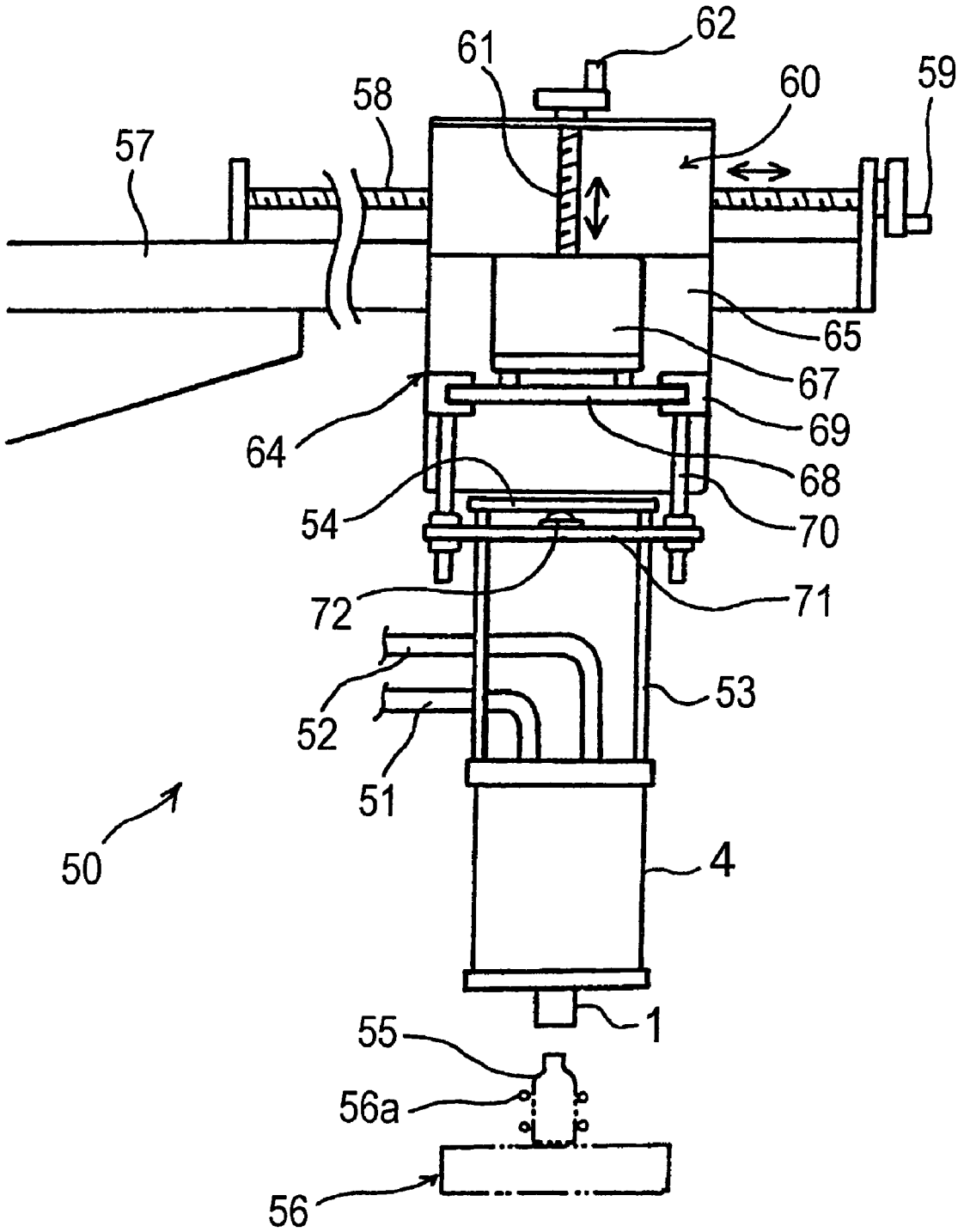
FIG. 10 is a front view showing one example of a liquefied gas dispensing apparatus according to the present invention schematically.
Figure 11:
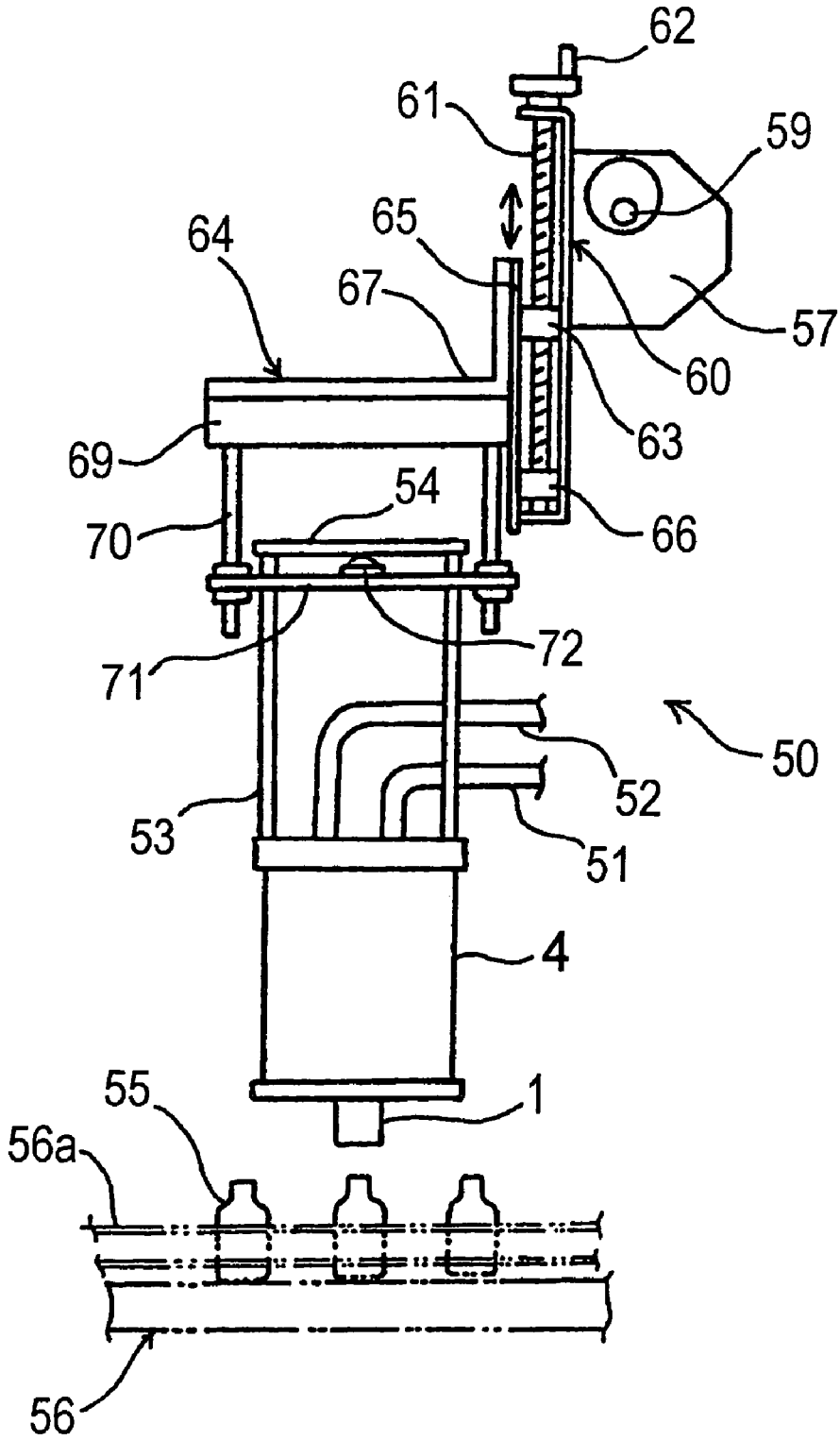
FIG. 11 is a side view showing the liquefied gas dispensing apparatus shown in FIG. 10 schematically.

Next, here will be described the liquefied gas dispensing apparatus according to the present invention on which the aforementioned nozzle 1 or 100 may be employed. One example is shown in FIGS. 10 and 11. Although any of nozzles 1 and 100 may be employed on the liquefied gas dispensing apparatus 50 shown therein, the embodiment of employing the nozzle 1 as shown in FIGS. 1 and 4 will be described hereinafter.

The liquefied gas dispensing apparatus 50 as shown in FIGS. 10 and 11 comprises a reserving tank 4 for temporarily reserving the low temperature liquefied gas (liquid nitrogen or liquefied argon etc.) fed from a not shown supplying source (a liquefied gas cylinder or the like). The nozzle 1, which is possible to be controlled over its opening and closing operation, is mounted in the lower end face side of the reserving tank 4. Also, a flexible liquefied gas feeding conduit 51 and a flexible exhaust conduit 52 are connected to the upper end face side of the reserving tank 4 individually.

The exhaust conduit 52 is open to the atmosphere, so that vaporized gas in the reserving tank 4 is released to the atmosphere and the inside of the reserving tank 4 is held under atmospheric pressure at all time. Also, a valve (not shown) is arranged on the halfway of the liquefied gas feeding conduit 51. This valve is controlled over its opening and closing operation, so as to flow approximately equal amount of the liquefied gas to that flown out of the nozzle 1 into the reserving tank 4 from the supply source such as the liquefied gas cylinder. A detail of the control of opening and closing operation will be described hereafter. Accordingly, it is constructed to make the amount of the liquefied gas, i.e., the height of the liquid level in the reserving tank 4 constant.

In the reserving tank 4, rod members 53 leading upward individually from four corners of the upper end, and a plate member 54 to be fixed onto the upper end of each rod member 53 are provided integrally to construct a hanging portion. Accordingly, the reserving tank 4 hangs freely in the vertical direction through the hanging portion which includes rod members 53 and the plate member 54.

Namely, there is provided a supporting base portion 57, which protrudes with leading in the direction perpendicular to a conveying route 56 for conveying the containers 55 such as the bottle shaped can or the like, in the position where it is sufficiently distant above the conveying route 56. A horizontal ball screw shaft 58 is held rotatably by the supporting base portion 57 and in parallel with the supporting base portion 57. And a hand wheel 59 for rotating the horizontal ball screw shaft 58 is mounted on the end portion of the horizontal ball screw shaft 58. Moreover, a bolt screw nut (not shown) is screwed onto the horizontal ball screw shaft 58, and a horizontally movable portion 60 which is constructed of a longitudinal plate member having a frame portion on its upper end edge and its lower end edge is fixed to the ball screw nut integrally.

A vertical ball screw shaft 61 leading in the vertical direction is mounted on the horizontally movable portion 60 rotatably by means of an operation with a hand wheel 62, and a vertically movable portion 64, which is constructed of a number of members, is fixed integrally with a ball screw nut 63 which is to be screwed to the vertical ball screw shaft 61, at the longitudinal plate member 65. Moreover, a guide hole member 66 fixed to the longitudinal plate member 65 is fitted to the lower end portion of the vertical ball screw shaft 61 in the rotatable condition.

Accordingly, the horizontally movable portion 60 is moved in the horizontal direction (in the direction perpendicular to the conveying direction of the container 55), by means of rotating the horizontal ball screw shaft 58 with the hand wheel 59. Also, the vertically movable portion 64 is moved in the vertical direction by means of rotating the vertical ball screw shaft 61 with the hand wheel 62.

In addition, the vertically movable portion 64 is constructed by integrally assembling the longitudinal plate member 65, the guide hole member 66, an L-shaped plate member 67, a horizontal plate member 68, a pair of right and left frame members 69, four of rod members 70, and a backing plate member 71.

The upper end portion of the rod members 53, which are parts of the hanging portion fixed to the reserving tank 4, penetrate the backing plate member 71 of the vertically movable portion 64, slidably in the vertical direction. Also, since the plate member 54 constituting a part of the hanging portion is positioned above the backing plate member 71, the reserving tank 4 hangs freely in the vertical direction from the backing plate member 71 of the vertically movable portion 64 through those rod members 53 and the plate member 54.

Also, there is provided a load sensor (a load cell or the like) 72 between the plate member 54 as a hanging portion of the reserving tank 4 and the backing plate member 71 of the vertically movable portion 64 which is held by the supporting base portion 57, so that the weight of the reserving tank 4 can be detected (measured) by the load sensor 72 sandwiched between both of the plate members 54 and 71. Here, the fluctuation factor of the weight of the reserving tank 4 is only the amount of the liquefied gas inside of the reserving tank 4.

Next, another embodiment of the liquefied gas dispensing apparatus in which the mechanism for adjusting the vertical position, and the position in the direction perpendicular to the conveying direction of the container 55, of the reserving tank 4 differs from that of the aforementioned embodiments, will be described hereinafter.

Figure 12:
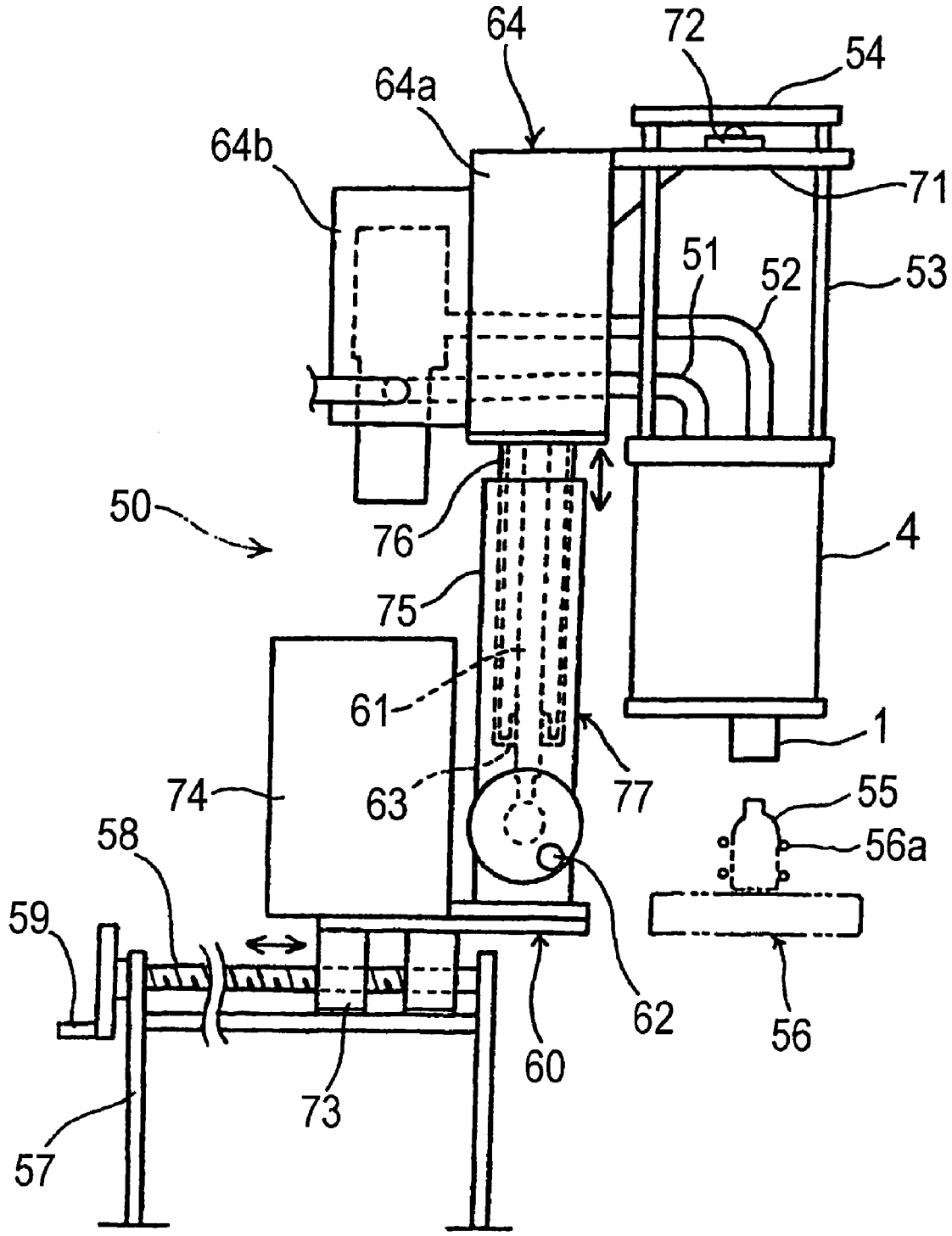
FIG. 12 is a front view showing another example of a liquefied gas dispensing apparatus according to the present invention schematically.
Figure 13:
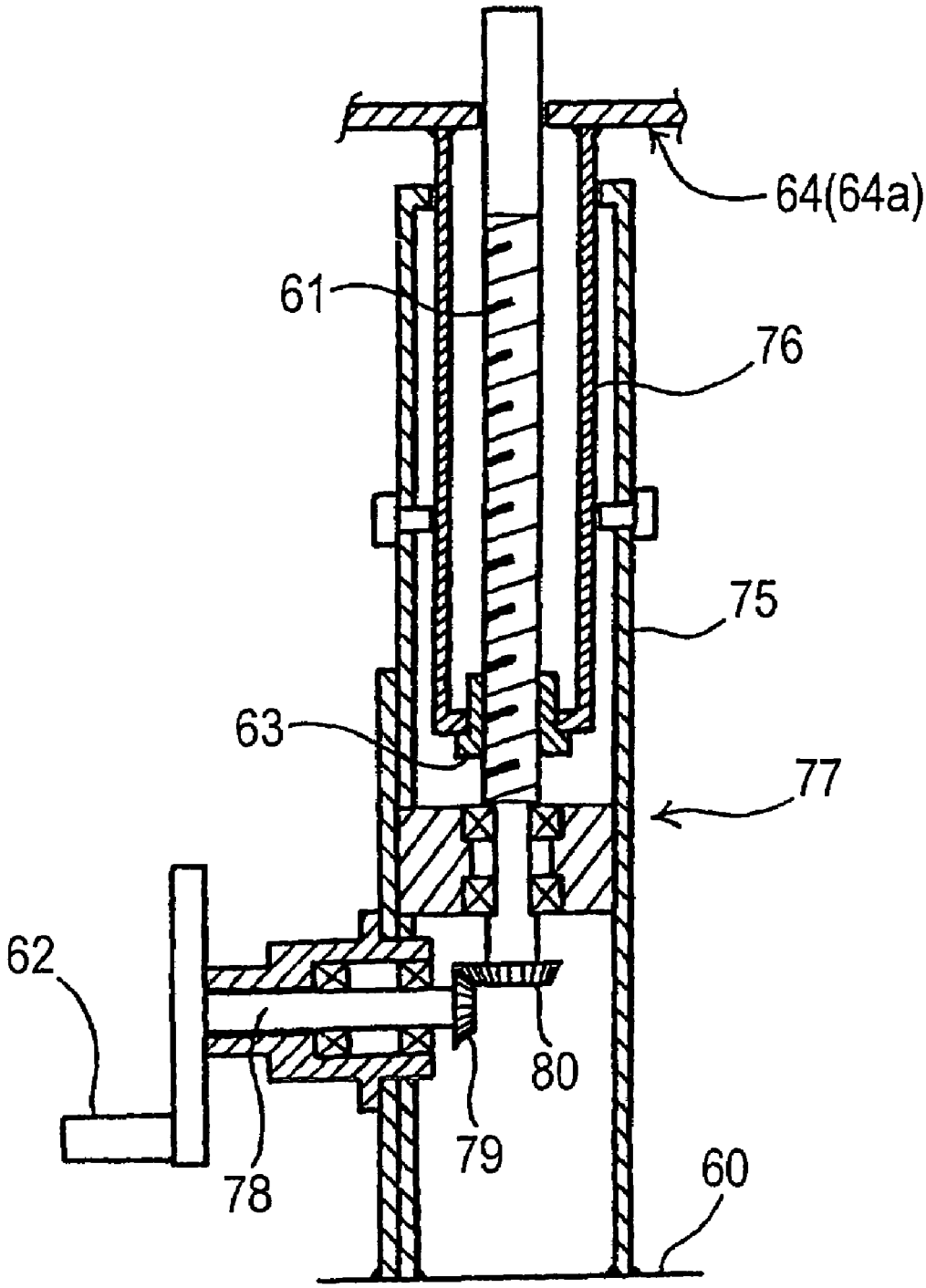
FIG. 13 is a sectional view showing a mechanism for moving a reserving tank in the liquefied gas dispensing apparatus shown in FIG. 12 vertically.

In the liquefied gas dispensing apparatus as shown in FIGS. 12 and 13, the supporting base portion 57 is arranged in a comparatively lower position of the side of the conveying route 56 of the container 55. The laid plate-like horizontally movable portion 60 is fixed integrally to the ball screw nut 73 which is screwed to the horizontal ball screw shaft 58 mounted to the supporting base portion 57 in the rotatable condition. A control panel 74 which has a micro computer or the like is mounted on the upper face of the horizontally movable portion 60. Moreover, a column portion 77 for lifting application having an outer cylindrical member 75 and an inner cylindrical member 76 supports the vertically movable portion 64 in the vertically movable condition, and the column portion 77 is mounted to the horizontally movable portion 60.

The structure of the column portion 77 is shown specifically in FIG. 13. The outer cylindrical member 75 which is fixed to the horizontally movable portion 60 in an erected condition, and the inner cylindrical member 76 whose upper end portion is fixed to the vertically movable portion 64, are fitted concentrically so as to make a dual structure. The outer cylindrical member 75 and the inner cylindrical member 76 are impossible to rotate relative to each other, but possible to move relative to each other in the vertical direction.

Moreover, a horizontal driving shaft 78 which may be rotated by the operation of the hand wheel 62 is arranged on the lower portion of the outer cylindrical member 75, by protruding its opposite end portion to the end portion attached with the hand wheel 62 toward inside of the outer cylindrical member 75. Also, the vertical ball screw shaft 61 leading along the center axes of the outer cylindrical member 75 and the inner cylindrical member 76 is held by the outer cylindrical member 75 in the rotatable condition, and the lower end portion of the ball screw shaft 61 is arranged near the leading end portion of the horizontal driving shaft 78. Bevel gears 79 and 80 engaging each other are attached to the leading end portion of the horizontal driving shaft 78 and the lower end portion of the vertical ball screw shaft 61 individually. Accordingly, the vertical ball screw shaft 61 is rotated through the horizontal driving shaft 78.

Furthermore, a ball screw nut 63 screwed with the vertical ball screw shaft 61 is fixed integrally to the lower end of the inner cylindrical member 76. The upper end portion of the vertical ball screw shaft 61 is held in the rotatable condition by a guide hole which is formed in a lower face side of the vertically movable portion 64 (more specifically, a main box member 64*a* of the vertically movable portion 64).

When the horizontal driving shaft 78 is rotated by operating the hand wheel 62, accordingly, the vertical ball screw shaft 61 is rotated by a torque transmitted through the bevel gears 79 and 80. Moreover, as a result of the rotation of the vertical ball screw shaft 61, the ball screw nut 63 engaged therewith is moved in the vertical direction, the inner cylindrical member 76 fixed to the ball screw nut 63 is moved in the vertical direction, then, the vertically movable portion 64 fixed to the inner cylindrical member 76 is moved in the vertical direction.

Here, as shown in FIG. 12, the aforementioned vertically movable portion 64 is constructed by integrally assembling the main box member 64*a*, a sub box member 64*b*, and the backing plate member 71. The inner cylindrical member 76 constituting a part of the column portion 77 is fixed to the lower face side of the main box member 64*a*, and the backing plate member 71 for supporting the reserving tank 4 is arranged with protruding to the conveying route 56 side from the upper end of the main box member 64*a*. Moreover, the liquefied gas feeding conduit 51 and the exhaust conduit 52 being connected to the reserving tank 4 are gathered in the main box member 64*a* once, then, connected to the supplying source or conducted in the air through inside of the sub box member 64*b*.

According to the aforementioned construction as shown in the example of FIGS. 12 and 13, each hand wheel 62 and 59 for moving the reserving tank 4 in the vertical direction and in the horizontal direction (in the direction perpendicular to the conveying direction of the container 55) are arranged in the comparatively lower positions in comparison with the construction shown in FIGS. 10 and 11; therefore, it is possible to operate each hand wheel 62 and 59 in a regular and comfortable position when operating those manually.

According to the constructions of the liquefied gas dispensing apparatus 50 as shown in the examples of FIGS. 10 and 11 or in FIGS. 12 and 13, it is possible to move the horizontally movable portion 60 in the horizontal direction (in the direction perpendicular to the conveying direction of the container 55) by operating the hand wheel 59 to rotate the horizontal ball screw shaft 58, and it is possible to move the vertically movable portion 64 in the vertical direction by operating the hand wheel 62 to rotate the vertical ball screw shaft 61. Namely, heights or positions of the reserving tank 4 and the nozzle 1 may be changed easily by means of operating hand wheels 59 and 62. Also, the reserving tank 4 and the nozzle 1 may be moved easily to a position distant from the conveying route 56 of the container 55 in the side direction (40 to 150 cm, preferably 60 to 100 cm), and it may be returned easily to an initial position from the distant position after the movement.

On that account, even if there is a change in size (the height or the outer diameter) of the container 55 due to alteration of the products to be manufactured in the manufacturing line wherein the liquefied gas dispensing apparatus 50 is provided, the position or the height of the reserving tank 4 or the nozzle 1 may be adjusted easily in accordance with that change. Also, the reserving tank 4 or the nozzle 1 may be easily moved to the position distant from the conveying route 56 of the container 55 in the side direction, and it may be returned to the side of the conveying route 56 of the container 55, when a width or a height of guide rails 56*a*, 56*a*, 56*a*, 56*a* of the conveying route 56 is changed in compliance with the variation in the size of the container 55, and when the necessity of dispensation of the liquefied gas does not arise or arises again due to the alteration of the product to be manufactured. Consequently, the reserving tank 4 and the nozzle 1 do not disturb the changing operation of the guide rails 56*a*, 56*a*, 56*a*, 56*a* and it is possible to survey the manufacturing line from afar.

Moreover, in each of the aforementioned liquefied gas dispensing apparatuses 50, the liquefied gas in the reserving tank 4 is flown or dropped from the nozzle 1 by its own weight under the condition that the liquid level in the reserving tank 4 is maintained within the predetermined range, and that the internal pressure on the liquid level in the reserving tank 4 is generally atmospheric pressure. In order to make the flow rate or the dropping rate of the liquefied gas constant in accordance with the opening degree of the nozzle 1, therefore, it is necessary to stabilize the liquid level. In the aforementioned embodiment, the load sensor 72 is employed for maintaining the height of the liquid level of the liquefied gas in the reserving tank 4 instead of the liquid level sensors, and supply amount of the liquefied gas to the reserving tank 4 is controlled in accordance with the detection result of the load sensor 72 concerning the weight of the reserving tank 4. Specifically, feeding the liquefied gas into the reserving tank 4 by means of opening the valve in consequence that the weight of the reserving tank 4 becomes a predetermined lower limit of the weight, and then, halting the feeding of the liquefied gas by means of closing the valve in consequence that the weight of the reserving tank 4 becomes a predetermined upper limit of the weight. Accordingly, the reserving tank 4 is fed with an accurate amount of the liquefied gas irrespective of waves or vibration on the liquid level. Moreover, the fluctuation range of the liquid level is reduced smaller than that which is possible to be detected by the liquid level sensors and controlled. Consequently, the liquid level in the reserving tank 4 is kept generally constant within the predetermined range.

Accordingly, it is possible for the liquefied gas, which is reserved in the reserving tank 4 and flown or dropped out of the nozzle 1 by its own weight to be dispensed to the container being conveyed, to be prevented from differing widely in its dispensational amount. Also, it is unnecessary to employ the liquid level sensors to be inserted into the reserving tank 4 from outside, so that an intrusion of the external heat into the reserving tank 4 accompanying the installation of the liquid level sensors is prevented. As a result, unnecessary waste of the liquefied gas is reduced.

Additionally, in the aforementioned embodiment, the load sensor 72 is arranged between the plate member 54 fixed to the reserving tank 4 and the backing plate member 71 held by the supporting base portion 57; therefore, the weight of the reserving tank 4 is detected without intruding the conveying route 56 of the container 55 positioned below the reserving tank 4.

Although the manufacturing line in which the liquefied gas dispensing apparatus 50 according to the present invention is to be arranged therein is generally a manufacturing line of canned beverages containing a beverage, it is not necessarily to be limited to the manufacturing line of canned beverages. For example, it may be a manufacturing line in which some other kind of containers such as a plastic bottle or a paper container is used. Otherwise, it may also be a manufacturing line of the contents other than beverages such as edible oils, chemicals, cosmetics and so on.

The liquefied gas dispensing apparatus according to the present invention is not limited to the structure as described in the above embodiments. For example, the mechanism for rotating each ball screw shaft may be a drive motor rather than the hand wheel. If the drive motor is used, it contributes to simplify operation as the reserving tank and the nozzle can be moved vertically or horizontally just by flipping switch buttons. Also, the means for detecting the weight of the reserving tank in order to keep the amount of the liquefied gas in the reserving tank constant is not limited to the aforementioned load sensor such as the load cell, and it may be a means in which the principle of a spring scale is applied. Moreover, for measuring the weight of the reserving tank, it may be constructed so as to measure the weight of the reserving tank with arranging the reserving tank on a predetermined supporting portion, other than hanging the reserving tank. Furthermore, it is also possible to keep the amount of the liquefied gas constant in the reserving tank by detecting the height of the liquid level in the reserving tank.

It is not necessarily for the packing member according to the present invention to be made from the synthetic resin. However, the packing member contacts with the upper faces of the cylinder and the fixing hole member repeatedly, and long running period will wear out those. Therefore, it is preferable for one of those contacting faces to be made from a soft material and to be structured interchangeable. For that reason, in the above mentioned embodiments, the packing member is made from the soft material and structured interchangeable when it is worn out.

Moreover, the inner circumferential face of the cylinder according to the present invention may be shaped into an oval cross sectional shape having a pair of flat faced walls being opposed to each other, other than the perfect circle shape. In this case, a plurality of slit portions may be formed in parallel on each flat faced wall, from the upper end to the lower end of the cylinder. By doing this, it is possible to gather a plurality of divided streams of the liquefied gas into a narrow range, by means of arranging the liquefied gas flowing nozzle to have the flat faced wall in parallel with the conveying direction of the can. Accordingly, it is suitable to flow the liquefied gas to the container whose opening portion has a small diameter.

Also, a plurality of slit portions formed on the inner circumferential face of the cylinder is not limited to the shape such that all its slit bottoms are inclined, as described in the aforementioned embodiments, and it is sufficient if the slit bottom is inclined in at least a pair of slit portions being opposed to each other out of a plurality of slit portions. Moreover, the number and dimensions of the slit portion may also be changed depending on the situation. Here, the flow rate of the liquefied gas will not be varied widely even though the position of the plug is relocated, if the number of slit portion having the inclined slit bottom is smaller. Therefore, it is preferable to arrange the slit portions in an appropriate number to flow the liquefied gas with being divided, and to incline all of (or most part of) those slit bottoms, in order to widen the varying range of the flow rate of the liquefied gas.

In the aforementioned embodiments, furthermore, the plug and the lower end of the rod for moving the plug are connected through the universal joint. However, the rod and plug may be connected directly if it is possible to bring the center axes of the rod for supporting the plug and the cylinder in line. Also, shapes of the upper end face of the cylinder and the fixing hole member may be a flat face or some other shapes other than the inclined face (e.g., mortar shaped concave curved face or mortar shaped tapered face) inclining downward from the outer circumferential portion to the center portion. That is to say, it is possible to change of design depending on the situation.

Numerous modifications and variations of the present invention are possible in light of the above teachings. It is therefore to be understood that within the scope of the appended claims, the invention may be practiced otherwise than as specifically described herein.

What is claimed is:

1. A liquefied gas dispensing nozzle comprising:

a cylinder with an axis in a vertical direction;

a plug slidably inserted into the cylinder from above;

a plurality of slit portions for letting through the liquefied gas formed in an inner circumferential face of the cylinder in parallel and in an axial direction of the cylinder from an upper end to a lower end of the cylinder, a width of at least one pair of mutually opposed slit portions in the plurality of slit portions is generally constant from the upper end to the lower end, a bottom of the at least one pair of mutually opposed slit portions is inclined so that a depth of the slits becomes gradually shallower from the upper end to the lower end of the cylinder, and each slit portion of the cylinder is closed by the plug when the plug is positioned at a lowest position relative to the cylinder;

a rod for reciprocating the plug; and a universal joint for connecting the rod and the plug movably, wherein the lower end of the at least one pair of slit portions having an inclined slit bottom is formed as a rounded corner portion.

2. The liquefied gas dispensing nozzle according to claim 1, wherein a curvature radius of the rounded corner portion is 0.1 mm to 0.5 mm.

3. The liquefied gas dispensing nozzle according to claim 1, wherein said cylinder includes a protruded portion extending downwardly from a lower peripheral edge of an internal bore.

4. The liquefied gas dispensing nozzle according to claim 2, wherein said cylinder includes a protruded portion extending downwardly from a lower peripheral edge of an internal bore.

5. The liquefied gas dispensing nozzle according to claim 1, wherein an upper end face of the cylinder includes an inclined face inclined downward from the outer circumferential portion to a central hole portion.

6. The liquefied gas dispensing nozzle according to claim 5, wherein the plug comprises a rod-shaped plug portion protruding downward and configured to contact the inner circumferential face of the cylinder, and a packing member including a softer material than a material of the cylinder and provided above the plug portion, wherein a shape of a lower face of the packing member is congruent with a shape of the upper end face of the cylinder.

7. The liquefied gas dispensing nozzle according to claim 6, wherein the packing member includes a synthetic resin.

* * * * *